US008581792B2

(12) United States Patent
Mukai et al.

(10) Patent No.: US 8,581,792 B2
(45) Date of Patent: Nov. 12, 2013

(54) RECEIVER APPARATUS, JUNCTION CABLE, AND POWER SUPPLY APPARATUS

(75) Inventors: Kouichi Mukai, Ishikawa (JP); Yoshitaka Yoshino, Tokyo (JP); Chisato Komori, Ishikawa (JP)

(73) Assignee: Sony Corporation, Tokyo (JP)

( * ) Notice: Subject to any disclaimer, the term of this patent is extended or adjusted under 35 U.S.C. 154(b) by 670 days.

(21) Appl. No.: 12/548,478

(22) Filed: Aug. 27, 2009

(65) Prior Publication Data

US 2010/0053005 A1 Mar. 4, 2010

(30) Foreign Application Priority Data

Aug. 28, 2008 (JP) ..... P2008-219320

(51) Int. Cl.
*H01Q 1/12* (2006.01)

(52) U.S. Cl.
USPC ..... 343/718; 343/702

(58) Field of Classification Search
USPC ..... 343/720, 718
See application file for complete search history.

(56) References Cited

U.S. PATENT DOCUMENTS

2007/0105438 A1* 5/2007 Yoshino ..... 439/578
2008/0122711 A1* 5/2008 Kimura et al. ..... 343/745

FOREIGN PATENT DOCUMENTS

JP 2006-25392 1/2006
JP 4105078 4/2008

* cited by examiner

*Primary Examiner* — Michael C Wimer
*Assistant Examiner* — Kyana R McCain
(74) *Attorney, Agent, or Firm* — Frommer Lawrence & Haug LLP; William S. Frommer

(57) ABSTRACT

A receiver apparatus includes: a main unit device; and a junction cable transmitting one or both of signal and electric power between the main unit device and an external device. The junction cable is a multicore coaxial cable having a plurality of core wire cables and a covered wire covering the plurality of core wire cables, and only the covered wire is cut locally so that the covered wire is divided into a main unit device-side covered wire and an external device-side covered wire. The main unit device transmits one or both of the signal and electric power by the core wire cable, and the main unit device-side covered wire or the core wire cable is connected to an antenna input port of a built-in tuner, and the main unit device receives a desired broadcast wave with the tuner using a high-frequency signal induced in the main unit device-side covered wire or the external device-side covered wire.

6 Claims, 23 Drawing Sheets

| | Vertical polarization | | | | | | | |
|---|---|---|---|---|---|---|---|---|
| Freq [MHz] | 470 | 520 | 570 | 620 | 670 | 720 | 770 | 906 |
| Peak [dBd] | -7.09 | -4.14 | -4.45 | -4.66 | -4.79 | -4.19 | -9.78 | -3.48 |

| | Horizontal polarization | | | | | | | |
|---|---|---|---|---|---|---|---|---|
| Freq [MHz] | 470 | 520 | 570 | 620 | 670 | 720 | 770 | 906 |
| Peak [dBd] | -8.62 | -3.03 | -2.96 | -4.59 | -5.39 | -2.81 | -8.18 | -9.28 |

| | Vertical polarization | | | | | | | |
|---|---|---|---|---|---|---|---|---|
| Freq [MHz] | 470 | 520 | 570 | 620 | 670 | 720 | 770 | 906 |
| Peak [dBd] | -10.36 | -7.94 | -8.86 | -9.06 | -9.79 | -4.16 | -8.58 | -2.68 |

| | Horizontal polarization | | | | | | | |
|---|---|---|---|---|---|---|---|---|
| Freq [MHz] | 470 | 520 | 570 | 620 | 670 | 720 | 770 | 906 |
| Peak [dBd] | -8.36 | -3.94 | -5.85 | -8.06 | -7.79 | -8.41 | -11.58 | -10.08 |

| | Vertical polarization | | | | | | | |
|---|---|---|---|---|---|---|---|---|
| Freq [MHz] | 470 | 520 | 570 | 620 | 670 | 720 | 770 | 906 |
| Peak [dBd] | -5.96 | -2.63 | -2.25 | -3.33 | -2.84 | -2.41 | -11.38 | -2.28 |

| | Horizontal polarization | | | | | | | |
|---|---|---|---|---|---|---|---|---|
| Freq [MHz] | 470 | 520 | 570 | 620 | 670 | 720 | 770 | 906 |
| Peak [dBd] | -7.22 | -2.94 | -2.45 | -4.13 | -4.59 | -0.81 | -9.38 | -7.28 |

| | Vertical polarization | | | | | | | |
|---|---|---|---|---|---|---|---|---|
| Freq [MHz] | 470 | 520 | 570 | 620 | 670 | 720 | 770 | 906 |
| Peak [dBd] | -9.36 | -7.94 | -9.05 | -9.86 | -8.24 | -3.36 | -8.58 | -2.13 |

| | Horizontal polarization | | | | | | | |
|---|---|---|---|---|---|---|---|---|
| Freq [MHz] | 470 | 520 | 570 | 620 | 670 | 720 | 770 | 906 |
| Peak [dBd] | -8.76 | -6.54 | -6.85 | -9.19 | -7.44 | -7.99 | -12.78 | -5.84 |

RECEIVER APPARATUS, JUNCTION CABLE, AND POWER SUPPLY APPARATUS

BACKGROUND OF THE INVENTION

1. Field of the Invention

The present invention relates to a receiver apparatus, a junction cable, and a power supply apparatus, which are applicable to, for example, a mobile telephone that can receive digital television broadcast. The invention makes it possible to configure an earphone antenna with a simple and small configuration while ensuring sufficient mechanical strength, by using a multicore coaxial cable for the cable for transmission of signals and electric power and cutting only the covered wire of the multicore coaxial cable at a mid portion thereof so that it can partially function as an antenna.

2. Description of Related Art

Mobile telephones that can receive television broadcast or the like in the past have received broadcast waves by built-in antennas or external antennas. The built-in antenna has an advantage that it does not spoil the styling of the mobile telephone. However, the built-in antenna has some drawbacks. For example, it is poorer in sensitivity than the external antenna, and it tends to be affected easily by internal noise.

On the other hand, examples of the external antenna include a telescopic antenna and an earphone antenna. The telescopic antenna has an advantage of better sensitivity than the built-in antenna. However, the telescopic antenna has some drawbacks. For example, it spoils the styling of the mobile telephone, and the antenna protrudes from the mobile telephone.

In particular, when the reception frequency is lower, the length of the antenna needs to be longer. In the case of the telescopic antenna, the antenna protrudes from the mobile telephone considerably, degrading the styling of the mobile telephone significantly. Specifically, for a UHF band with a frequency of 470 to 770 [MHz], the length of a monopole type telescopic antenna needs to be about 150 [mm]. On the other hand, for a VHF band with a frequency of 100 to 200 [MHz], the length of a monopole type telescopic antenna needs to be about 800 to 400 [mm]. Thus, the telescopic antenna protrudes from the mobile telephone considerably for the VHF band, degrading the styling thereof significantly.

In contrast, an earphone antenna uses a cable for an earphone as the antenna. The earphone antenna can prevent sensitivity deterioration and the adverse influence of internal noise without degrading the styling of the mobile telephone.

Regarding the earphone antenna, JP-A-2006-25392 discloses a configuration in which a high-frequency cut-off circuit is provided at a mid portion of a cable and only the cable on the device side from the high-frequency cut-off circuit is allowed to function as an antenna. The configuration of JP-A-2006-25392 can prevent performance deterioration resulting from the approaching and contacting of the earphone cable to a human body.

SUMMARY OF THE INVENTION

However, when a high-frequency cut-off circuit is provided at a mid portion of the cable, problems arise that the structure of the portion in which the high-frequency cut-off circuit is provided becomes complicated, and the size of that portion becomes large. Another problem is that the parts count increases. Still another problem is that the portion in which the high-frequency cut-off circuit is provided has poor mechanical strength.

The invention addresses the foregoing and other problems, and it is desirable to provide a receiver device, a junction cable, and a power supply apparatus that can solve these problems at one time.

According to an embodiment of the invention, there is provided a receiver apparatus including: a main unit device; and a junction cable configured to transmit one or both of signal and electric power between the main unit device and an external device, wherein: the junction cable is a multicore coaxial cable having a plurality of core wire cables and a covered wire covering the plurality of core wire cables, and in the junction cable, only the covered wire is cut locally so that the covered wire is divided into a main unit device-side covered wire and an external device-side covered wire; and the main unit device transmits one or both of the signal and electric power by the core wire cable, and the main unit device-side covered wire or the core wire cable is connected to an antenna input port of a built-in tuner, and the main unit device receives a desired broadcast wave with the tuner using a high-frequency signal induced in the main unit device-side covered wire or the external device-side covered wire.

According to another embodiment of the invention, there is provided a junction cable including: a multicore coaxial cable having a plurality of core wire cables and a covered wire covering the plurality of core wire cable; a main unit device-side connector provided at one end of the multicore coaxial cable and configured to connect the multicore coaxial cable to a main unit device; and an external device-side connector provided at the other end of the multicore coaxial cable and configured to connect the multicore coaxial cable to an external device, wherein only the covered wire is cut locally, and the covered wire is divided into a main unit device-side covered wire and an external device-side covered wire, the core wire cable transmits one or both of signal and electric power between the main unit device and the external device, and the main unit device-side covered wire or the core wire cable is connected via the main-unit side connector to an antenna input port of a tuner being built in the main unit device.

According to still another embodiment of the invention, there is provided a power supply apparatus including: a power supply unit configured to generate electric power for a main unit device; and a cable configured to supply the electric power generated by the power supply unit to the main unit device via a connector provided at one end, wherein the cable is a multicore coaxial cable having a plurality of core wire cables and a covered wire covering the plurality of core wire cables, only the covered wire is cut locally, and the covered wire is divided into a main unit device-side covered wire and an external device-side covered wire, the core wire cable supplies the electric power to the main unit device, and the main unit device-side covered wire or the core wire cable is connected via the connector to an antenna input port of a tuner being built in the main unit device.

According to the embodiments of the invention, only the covered wire is cut locally and divided into the main unit device-side covered wire and the external device-side covered wire. Thereby, the covered wire can be divided into the main unit device-side covered wire and the external device-side covered wire without reducing the strength of the core wire cable at all. Therefore, deterioration of the mechanical strength can be avoided effectively, and a portion of the covered wire can be made to function as an antenna. Moreover, since it is unnecessary to use a circuit board or the like, the size increase can be effectively avoided, and the cable can be configured so as to function as an antenna with a simple configuration.

According to the embodiments of the invention, it is possible to configure an earphone antenna in a simple and small configuration while ensuring sufficient mechanical strength.

DETAILED DESCRIPTION OF THE INVENTION

Hereinbelow, embodiments of the invention will be described with reference to the drawings. The description will be made according to the following order.

1. First Embodiment
2. Second Embodiment
3. Third Embodiment
4. Fourth Embodiment
5. Fifth Embodiment
6. Sixth Embodiment
7. Seventh Embodiment
8. Modified Example

First Embodiment

Configuration of the Embodiment

Overall Configuration

Figure 2:
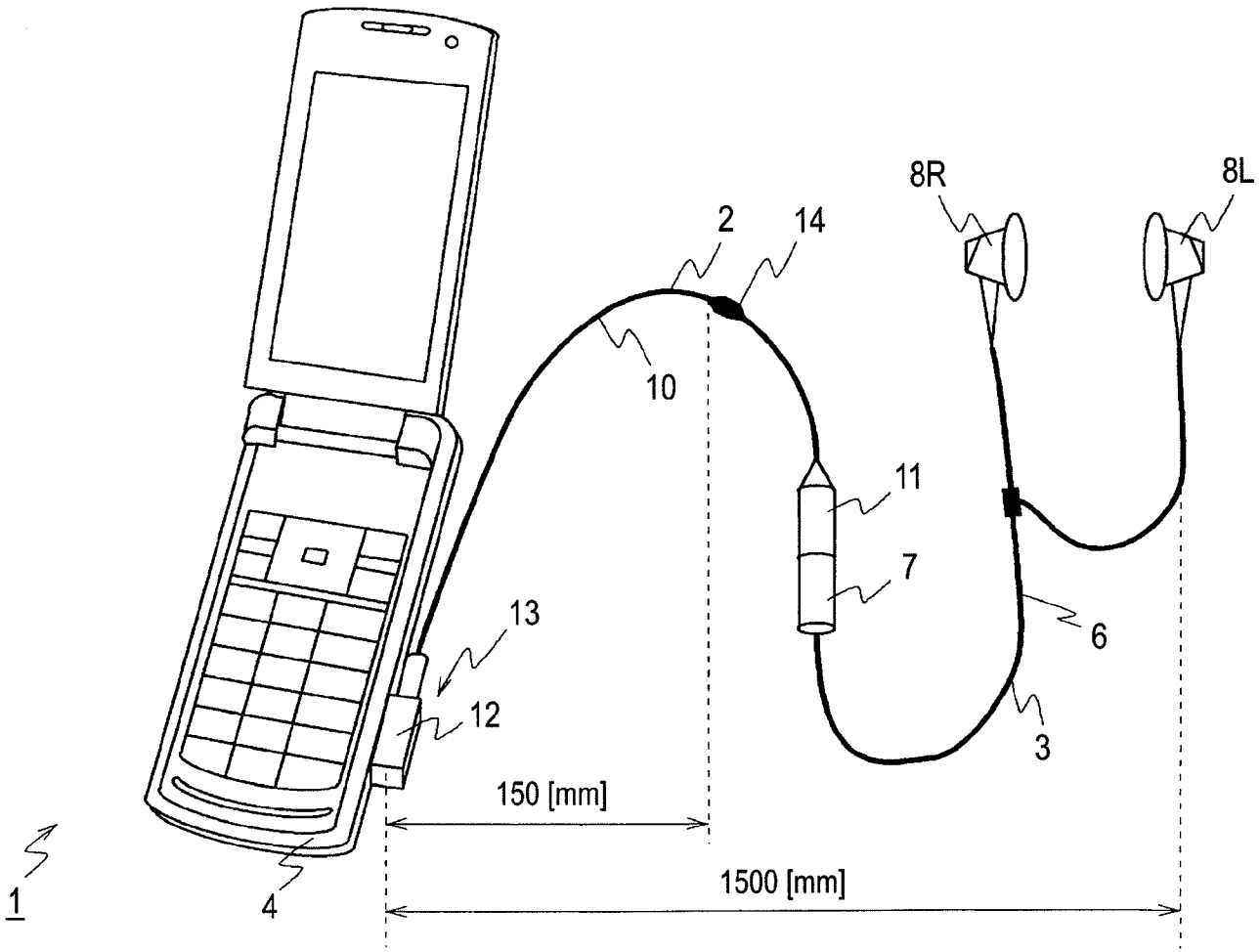
FIG. 2 is a perspective view showing the mobile telephone system according to the first embodiment of the invention.

FIG. 2 is a perspective view showing a mobile telephone system according to a first embodiment of the invention. This mobile telephone system 1 receives digital television broadcast and digital radio broadcast by an earphone antenna made of a junction cable 2 and an earphone 3. For this purpose, in the mobile telephone system 1, the earphone 3 is connected to a mobile telephone 4, which is a main unit device, via the junction cable 2. In the mobile telephone system 1, the total length of the junction cable 2 and the earphone 3 is set to be a length that is suitable for test listening for music or the like. In this embodiment, it is set at 1500 [mm].

In the earphone 3, a three-pin plug 7 is connected to one end of a cable 6, and right and left channel speakers 8R and 8L are connected to the other end of the cable 6. In the junction cable 2, a jack 11, which is to be connected to the plug 7 of the earphone 3, is provided at one end of a cable 10, and a plug 12 is provided at the other end of the cable 10. The mobile telephone 4 has, on a side face thereof, a jack 13 to be connected to the plug 12.

Figure 3:
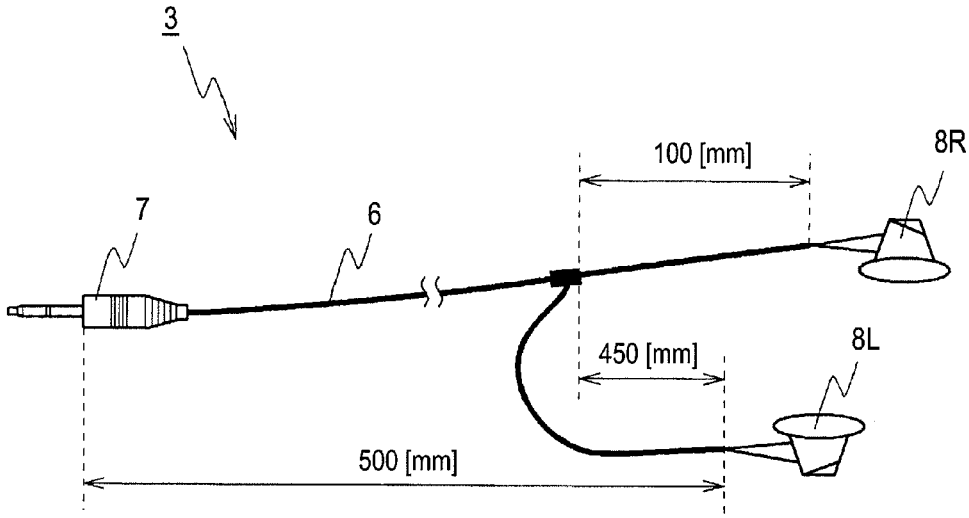
FIG. 3 is a side view showing an earphone applied to the mobile telephone system of FIG. 2.

More specifically, in the earphone 3, parallel two-wire cables extending respectively from the right and left channel speakers 8R and 8L are connected to a three-wire type flat cable in which a ground wire is communized for audio signals for the right channel and the left channel, as shown in FIG. 3.

The other end of the three-wire flat cable of the earphone 3 is connected to corresponding terminals 7L, 7R, and 7G (see FIG. 1) of the plug 7. In this embodiment, the lengths of the parallel two-wire cables extending from the right and left channel speakers 8R and 8L are set at 100 [mm] and 450 [mm], respectively. In addition, the length of the cable from the plug 7 to the left channel speaker 8L is set at 500 [mm].

Figure 4:
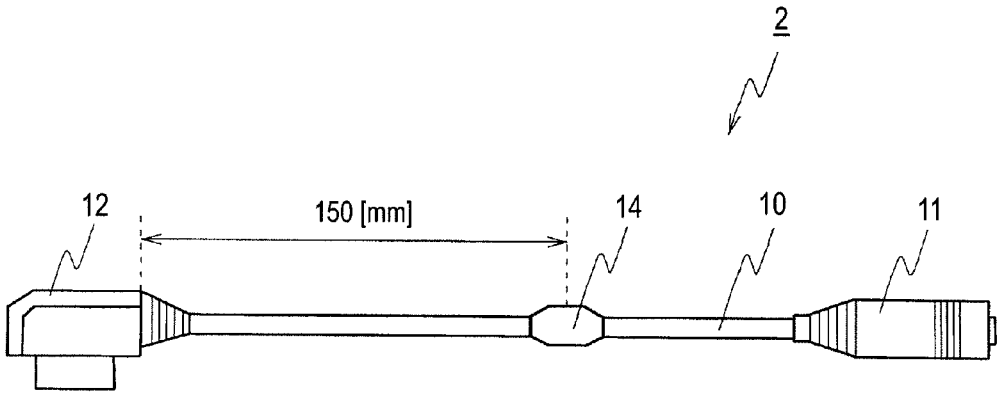
FIG. 4 is a side view showing a junction cable applied to the mobile telephone system of FIG. 2.
Figure 5B:
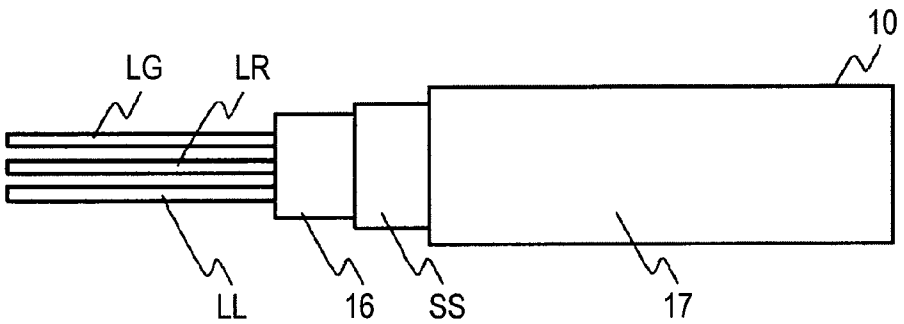
FIGS. 5A and 5B are views showing a multicore coaxial cable used for the junction cable of FIG. 4.
Figure 5A:
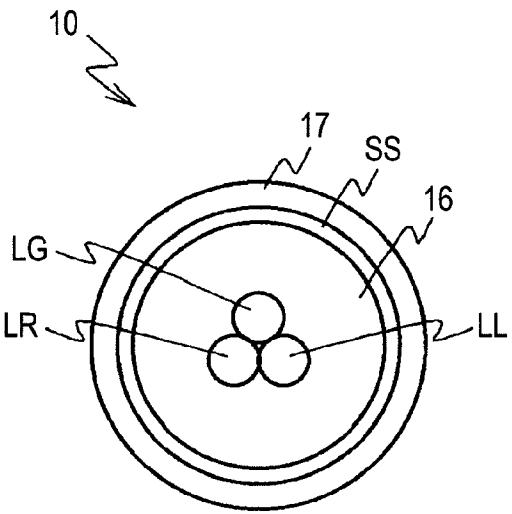

In the junction cable 2, an intermediate process portion 14 in which the cable 10 is processed locally is provided at a mid portion of the cable 10, as shown in FIG. 4. Here, as shown in the cross-sectional view and the side view of FIGS. 5A and 5B, the cable 10 is what is called a multicore coaxial cable that is made by covering a plurality of core wire cables LL, LG, and LR with a covered wire SS. Each of the core wire cables LL, LG, and LR is made by covering aramid fiber-reinforced twisted wires, and they are twisted and thereafter covered by an insulator 16 so as to be retained integrally. In the cable 10, the covered wire SS made of copper net wire is disposed so as to surround the insulator 16, and an outer jacket 17 is formed by covering the circumference with an elastomer. In the junction cable 2, the core wire cables LL, LR, and LG are assigned respectively to the hot side of the left channel audio signal, the hot side of the right channel audio signal, and a ground wire commonly provided for the left channel audio signal and the right channel audio signal.

Figure 1:
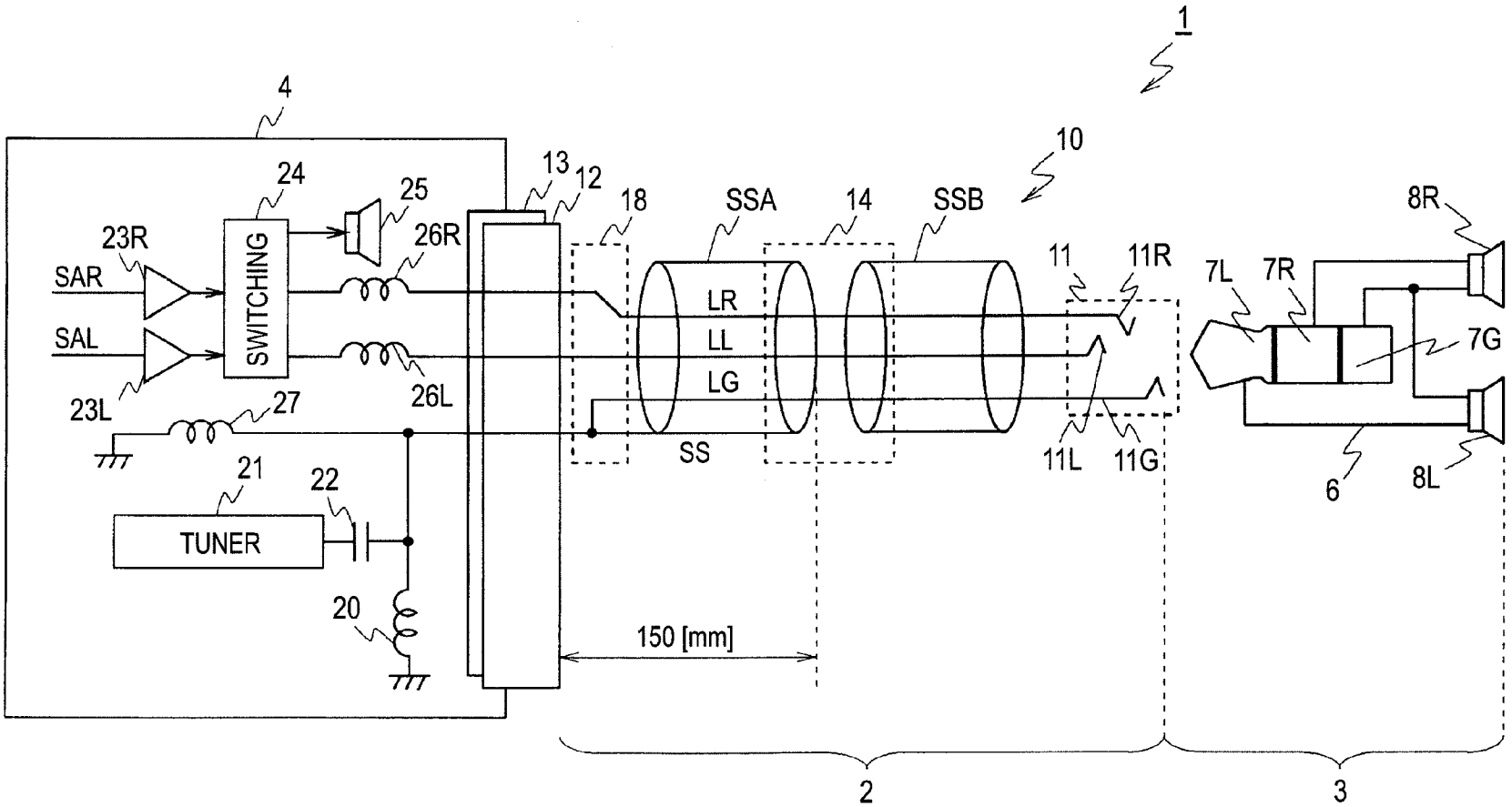
FIG. 1 is a connection diagram showing a mobile telephone system according to a first embodiment of the invention.

The intermediate process portion 14 is a portion in which, as shown in FIG. 1, the covered wire SS is cut so that the covered wire SS is divided into a main unit device-side covered wire SSA and an earphone-side covered wire SSB.

The plug 12 is a 10-pin multi-pin plug in a flat shape, formed so that the pins are continuously lined up closely in a longitudinal direction. The junction cable 2 is formed as follows; the core wire cables LL, LG, and LR and the covered wire SS of the cable 10 are connected to the corresponding pins of the plug 12 via a circuit board 18 provided on the rear face side of the plug 12, and thereafter, the rear face of the plug 12 is covered by a resin. In the junction cable 2, the covered wire SSA is connected to the core wire cable LG, assigned as ground wire, on the circuit board 18. Thus, in the junction cable 2, the intermediate process portion 14 side end of the main unit device-side covered wire SSA becomes an open end, which is not connected to any parts, while the plug 12 side end thereof is connected to the ground wire. On the other hand, the entirety of the earphone-side covered wire SSB is set to be in a condition in which it is not connected to any parts.

In the junction cable 2, the length of the main unit device-side covered wire SSA is set to be an electrical length about ¼ wavelength of the center frequency of the digital television broadcast band that is a UHF band. More specifically, in this embodiment, it is set to be about 150 [mm]. Thus, the junction cable 2 is configured so that the main unit device-side covered wire SSA functions as a monopole antenna of ¼ wavelength when receiving digital television broadcast. The junction cable 2 inputs a high-frequency signal induced in the main unit device-side covered wire SSA to the mobile telephone 4 via the ground pin of the plug 12.

The mobile telephone 4 is a mobile telephone that has the function to receive digital television broadcast and digital radio broadcast. It is furnished with a tuner 21 for receiving digital television broadcast and digital radio broadcast. In the mobile telephone 4, the ground terminal of the jack 11 is connected to the ground wire of the tuner 21 via a high-frequency cut-off circuit 20 for cutting off high frequency. In addition, the ground terminal of the jack 11 is connected to the antenna input port of the tuner 21 via a capacitor 22. Thereby, the mobile telephone 4 inputs a high-frequency signal induced in the main unit device-side covered wire SSA to the tuner 21. Note that the high-frequency cut-off circuit 20 is constructed of, for example, a chip inductor.

The mobile telephone 4 amplifies the right and left channel audio signals SAR and SAL obtained from the tuner 21 by amplifier circuits 23R and 23L, respectively, and thereafter inputs them to a built-in speaker 25 via a switching circuit 24.

When the junction cable 2 is connected, the mobile telephone 4 stops the output of the audio signals SAR and SAL to the built-in speaker 25, and outputs the audio signals SAR and SAL to the junction cable 2 via the jack 13. Thereby, the mobile telephone 4 provides the audio signals SAL and SAR to the user by the earphone 3 in place of the built-in speaker 25 when the junction cable 2 is connected thereto.

It should be noted that in the mobile telephone 4, high-frequency cut-off circuits 26L and 26R are provided between the switching circuit 24 and the jack 13, and the ground terminal of the jack 13 is connected to the audio output-side ground wire via a high-frequency cut-off circuit 27. Thereby, the mobile telephone 4 prevents the high-frequency signal induced in the junction cable 2 from being mixed into the audio output system and so forth. Note that, like the high-frequency cut-off circuit 20, these high-frequency cut-off circuits 26L, 26R, and 27 are constructed of chip inductors.

[Detailed Configuration of the Intermediate Process Portion]

Figure 6A:
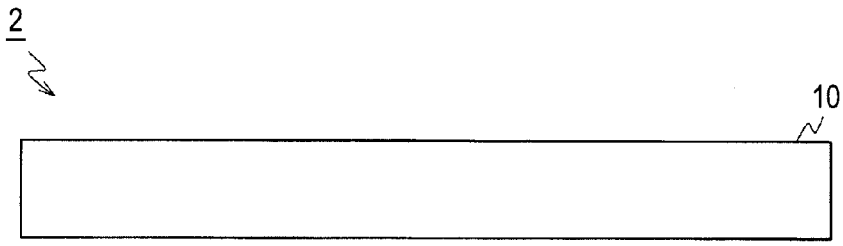
FIGS. 6A to 6D are views for illustrating processing for the junction cable of FIGS. 5A and 5B.
Figure 6B:
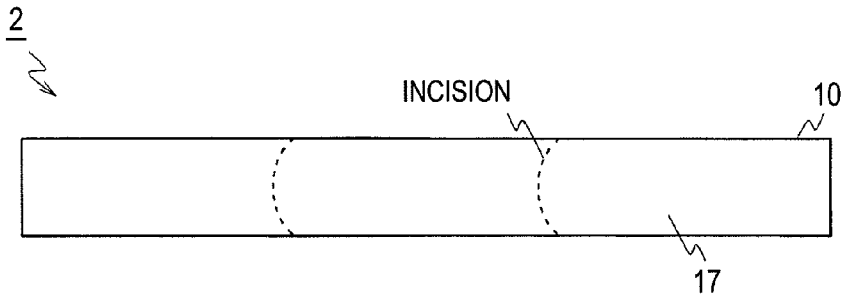
Figure 6C:
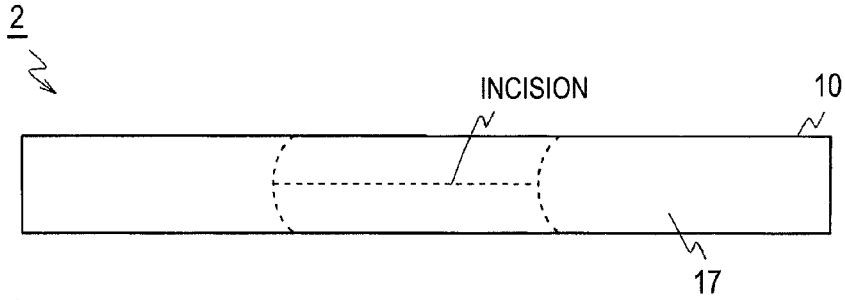
Figure 6D:
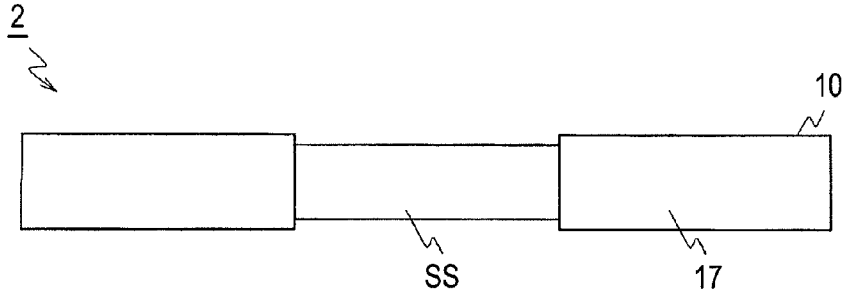

FIGS. 6A to 7C are side views used for illustrating the procedure of making the intermediate process portion 14. After cutting the cable 10 in a predetermined length as shown in FIG. 6A, incisions are formed at portions of the cable 10 corresponding to both ends of the intermediate process portion 14 in the junction cable 2, as shown in FIG. 6B, so that only the outer jacket 17 is cut in a slice shape. Subsequently, as shown in FIG. 6C, an incision is made in the outer jacket 17 in a linear shape so as to connect the incisions of the portions corresponding to both ends, and the outer jacket 17 is partially removed by these incisions, as shown in FIG. 6D. Thereby, the junction cable 2 is configured so that the covered wire SS is exposed in a portion corresponding to the intermediate process portion 14.

Figure 7A:
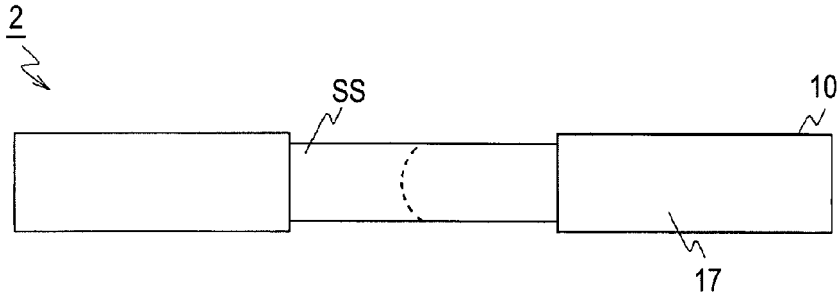
FIGS. 7A to 7C are views for illustrating the processing subsequent to FIGS. 6A to 6C.
Figure 7B:
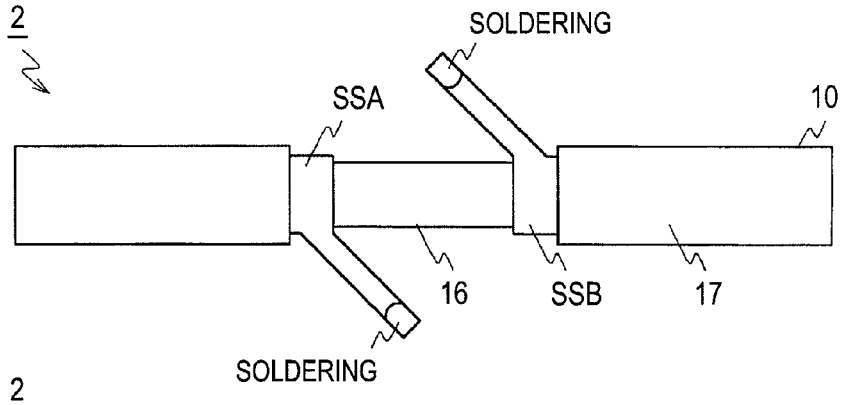

Subsequently, in the junction cable 2, the covered wire SS that is in the exposed portion is cut into two portions at substantially the center portion along the longitudinal direction, as indicated by the dashed line in FIG. 7A. Next, in the junction cable 2, the covered wire SS of this exposed portion is unraveled, and thereafter, bare copper wires that form the covered wire SS are twisted and bundled so that they protrude sideward at the plug 12 side and the jack 11 side, as shown in FIG. 7B. The junction cable 2 is so formed that the directions in which the bundled portions protrude are opposite to each other at the plug 12 side and the jack 11 side, and that they are tilted toward the center. In the junction cable 2, the bundled portions are soldered so that these bundled bare copper wires do not unravel.

Figure 7C:
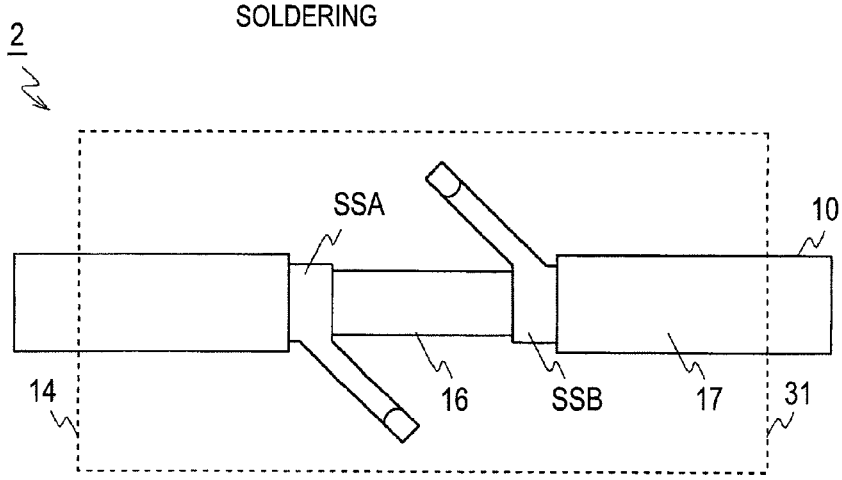
Figure 8:
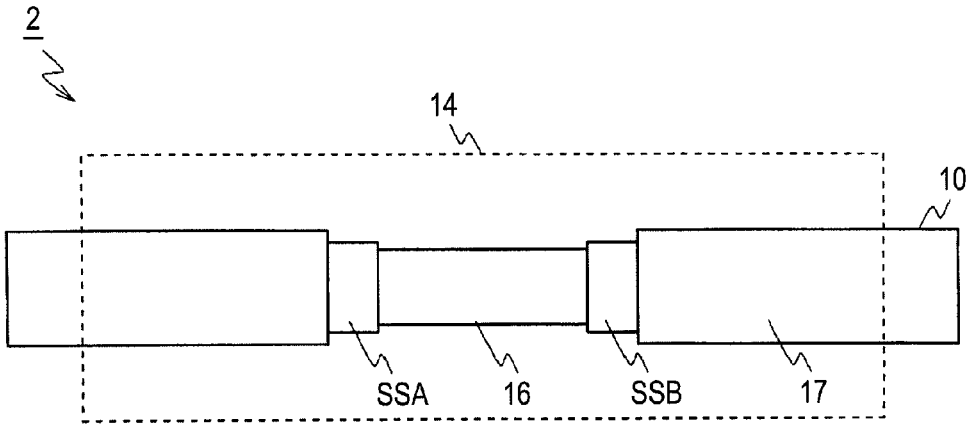
FIG. 8 is a view for illustrating another processing for the junction cable of FIGS. 5A and 5B.
Figure 9:
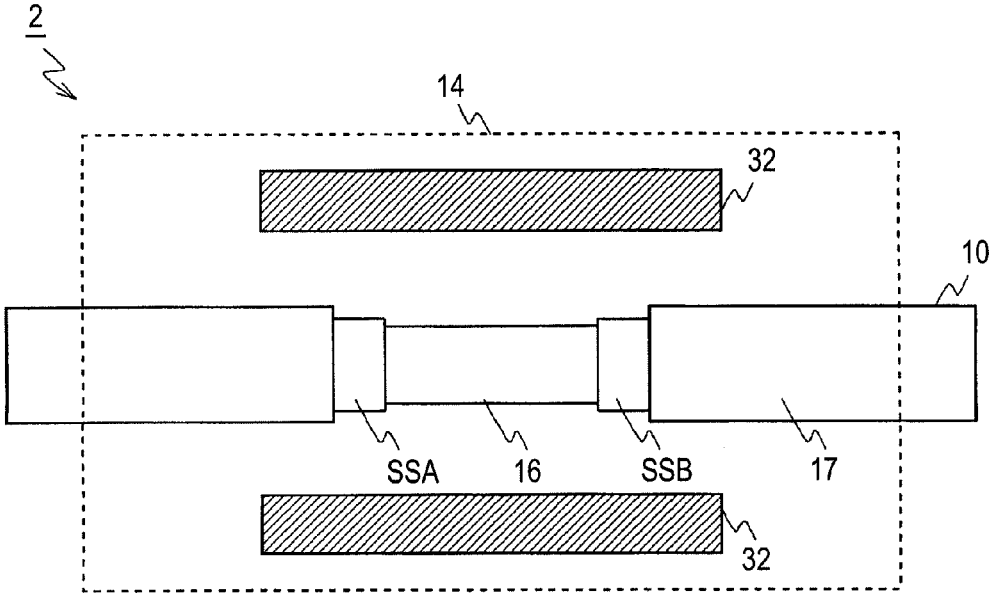
FIG. 9 is a view for illustrating another processing for the junction cable of FIGS. 5A and 5B, which is different from that of FIG. 8.

Subsequently, as shown in FIG. 7C, a certain area of the junction cable 2 including the portion from which the outer jacket 17 has been removed is molded by a resin 31 so as to conceal the bundled portion, to thereby form the intermediate process portion 14. It should be noted that when practically sufficient tensile strength can be ensured in the intermediate process portion 14, it is possible to omit the process of unraveling the bare copper wires of the covered wire SS and the process of bundling the wires, as shown in FIG. 8. However, in this case, it is desirable that the covered wire SS should be removed like as the outer jacket 17 and the insulator 16 should be exposed so that the main unit device-side covered wire SSA and the earphone-side covered wire SSB are insulated from each other completely. In addition, as shown in FIG. 9, high frequency insulation between the main unit device-side covered wire SSA and the earphone-side covered wire SSB may be made more reliably by inserting the cable 10 through a core 32 in a tubular shape and disposing the core 32 at the intermediate process portion 14.

Operation of the Embodiment

In the mobile telephone system 1 (FIGS. 1 and 2), the tuner 21 starts up its operation in response to the user's manipulation, and the audio signals SAL and SAR received by the tuner 21 are output from the built-in speaker 25, according to the above-described configuration.

In the mobile telephone system 1, when the junction cable 2 is connected to the mobile telephone 4, the audio signals SAL and SAR are output to the junction cable 2 in place of the built-in speaker 25. In the mobile telephone system 1, the audio signals SAL and SAR are supplied to the cable 6 of the earphone 3 via the core wire cables LL, LR, and LG of the junction cable 2, and the speakers 8L and 8R of the earphone 3 are driven by the audio signals SAL and SAR. In the mobile telephone system 1, the audio signals SAL and SAR are thereby transmitted to the earphone 3 via the junction cable 2, and the sound of the broadcast wave received by the tuner 21 is provided to the user by the earphone 3.

In the mobile telephone system 1, various high-frequency signals are induced in the cable 10 of the junction cable 2 and the cable 6 of the earphone 3 in the state in which the audio signals SAL and SAR are being transmitted to the earphone 3 via the junction cable 2.

Here, in the mobile telephone system 1, the cable 10 of the junction cable 2 that transmits the audio signals SAL and SAR is a multicore coaxial cable surrounded by the covered wire SS, and the covered wire SS is cut at a mid portion thereof so as to be divided into the main unit device-side covered wire SSA and the earphone-side covered wire SSB. In the mobile telephone system 1, the main unit device-side covered wire SSA is connected to the antenna input port of the tuner 21 on the mobile telephone 4 side. As a result, the high-frequency signal induced in the main unit device-side covered wire SSA is input to the antenna input port of the tuner 21.

In addition, the earphone-side covered wire SSB is not connected to any parts. Thereby, the high-frequency signal induced in the cable 6 of the earphone 3 and the high-frequency signal induced in the earphone-side covered wire SSB are input to the antenna input port of the tuner 21 via the grounding core wire cable LG.

Figure 10:
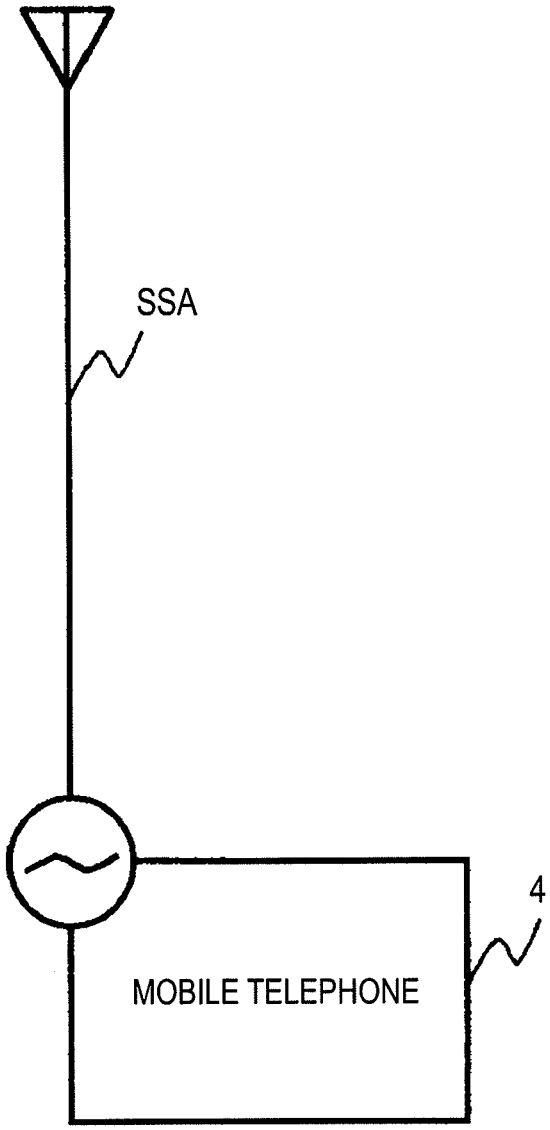
FIG. 10 is a view for illustrating a monopole antenna according to the mobile telephone system of FIG. 2.
Figure 11:
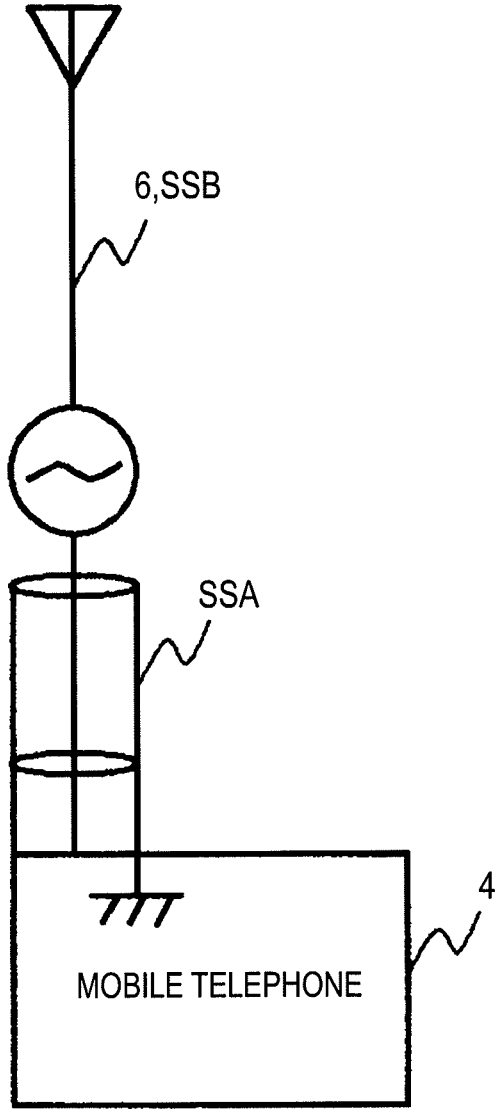
FIG. 11 is a view for illustrating a sleeve antenna according to the mobile telephone system of FIG. 2.

As a result, in the mobile telephone system 1, a monopole antenna is formed by the main unit device-side covered wire SSA, as shown in FIG. 10, and the broadcast wave induced in the monopole antenna is received by the tuner 21. In addition, in the case where the received frequency is low, the main unit device-side covered wire SSA functions as a coaxial transmission line together with the core wire cables LG, LR, and LL, so a sleeve antenna is formed by the earphone-side covered wire SSB and the cable 6 of the earphone, as shown in FIG. 11.

Here, in the mobile telephone system 1, the length of the monopole antenna formed by the main unit device-side covered wire SSA is set at a length corresponding to the digital television broadcast wave that is in a UHF band. Accordingly, when receiving digital television broadcast waves, the television broadcast is received by the monopole antenna formed by the main unit device-side covered wire SSA. On the other hand, when receiving the digital radio broadcast that is in a VHF band, the broadcast waves are received by the sleeve antenna formed by the earphone-side covered wire SSB and the cable 6 of the earphone.

Figure 12:
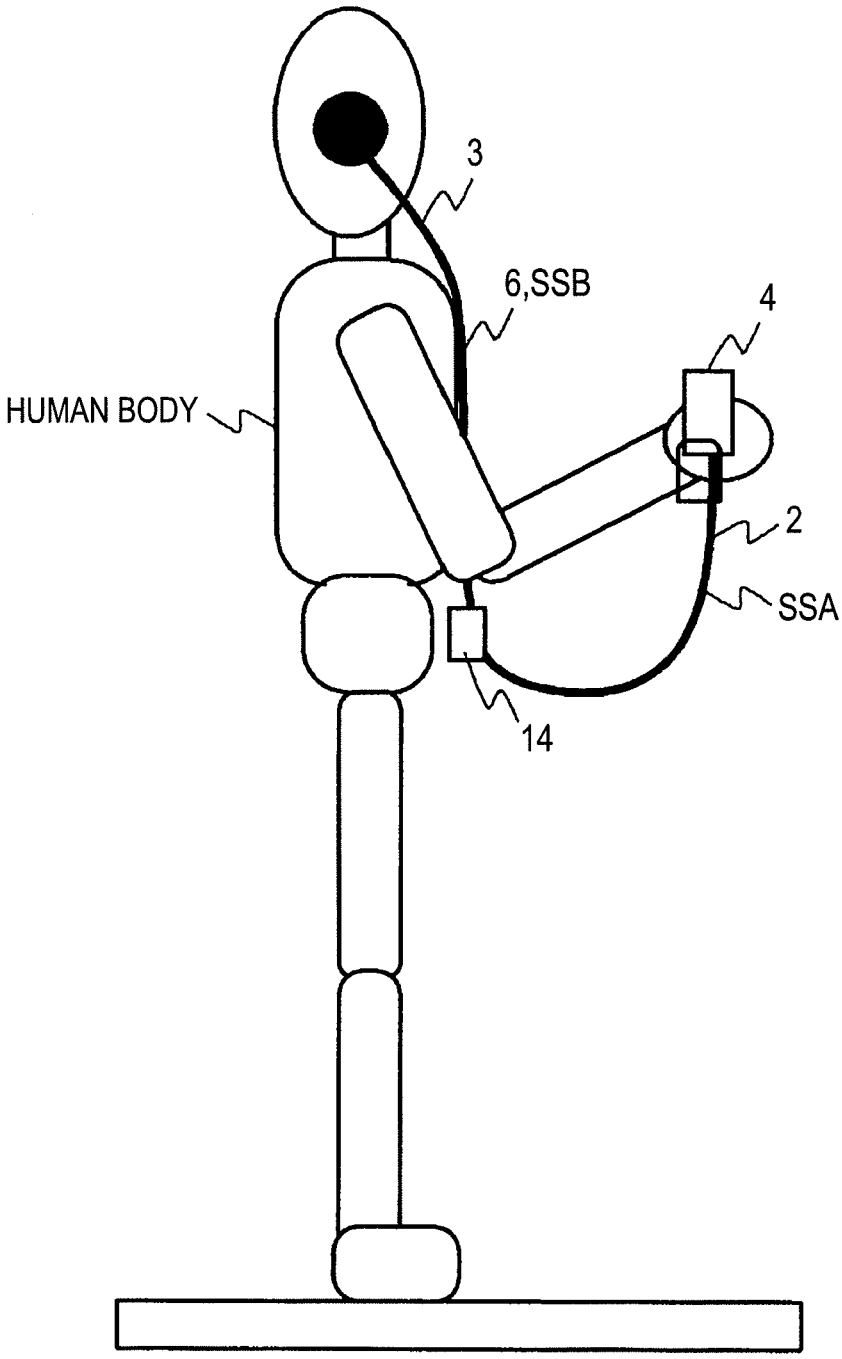
FIG. 12 is a view for illustrating an influence of a human body on the mobile telephone system of FIG. 2.

As shown in FIG. 12, the cable 6 of the earphone 3 and the earphone-side covered wire SSB are parts that tend to make contact with a human body easily when the earphone 3 is put on. The UHF band is a frequency band that causes the performance of the antenna to vary considerably by the contacting with a human body. In contrast, the main unit device-side covered wire SSA is a part that does not come into contact with a human body easily. Therefore, this embodiment makes it possible to avoid the performance deterioration resulting from the contacting with a human body effectively in the UHF band, in which the performance deterioration resulting from the contacting with a human body is noticeable.

Figure 13:
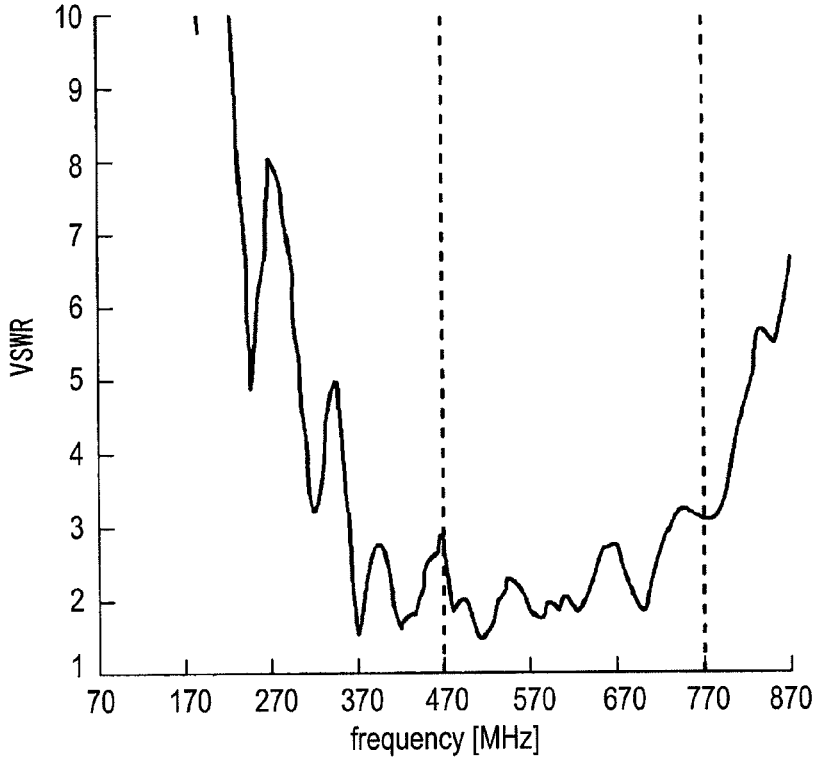
FIG. 13 is a characteristic curve graph showing VSWR of an antenna according to the mobile telephone system of FIG. 2.
Figure 14:
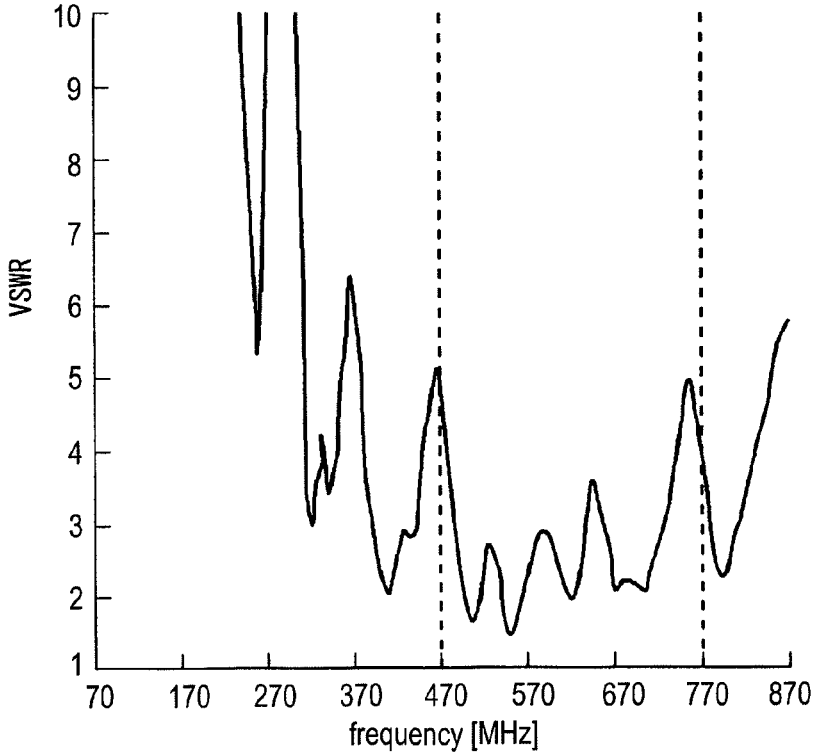
FIG. 14 is a characteristic curve graph showing VSWR of a related-art antenna, in comparison with FIG. 13.

FIG. 13 is a characteristic curve graph showing VSWR in a UHF band of the antenna in the mobile telephone system 1. FIG. 14 is a characteristic curve graph showing VSWR in the case where the intermediate process portion 14 is not provided, in comparison with FIG. 13. FIG. 14 shows the measurement results for the configuration in which the part that is in contact with the human body is also made to function as an antenna. FIG. 14 shows the results for an example of the case as follows: the junction cable is formed by a multicore coaxial cable a length of 940 [mm]; the core wire cable and the covered wire of this junction cable are short-circuited on the main unit device-side end and input to the tuner; and a tip of the junction cable is connected to the earphone. FIGS. 13 and 14 show the characteristics measured in a free space, and the dashed lines indicate the reception band. FIGS. 13 and 14 demonstrates that the VSWR is reduced in the reception band in the case of the antenna of the mobile telephone system 1.

Figures 15, 16, 17:
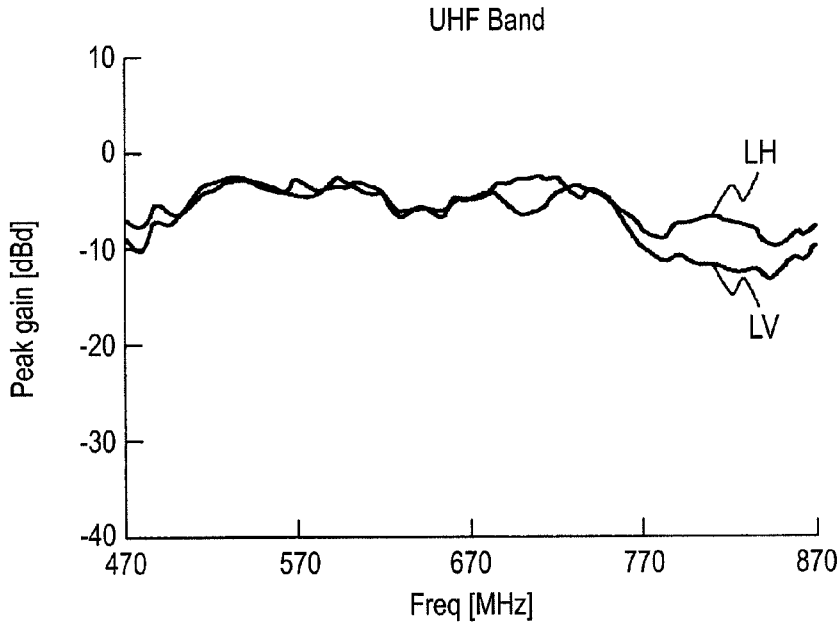
FIG. 15 is a characteristic curve graph showing the characteristics of an antenna according to the mobile telephone system of FIG. 2.
FIG. 16 is a table showing the characteristics of vertical polarization in the characteristic curve graph of FIG. 15.
FIG. 17 is a table showing the characteristics of horizontal polarized wave in the characteristic curve graph of FIG. 15.
Figures 18, 19, 20:
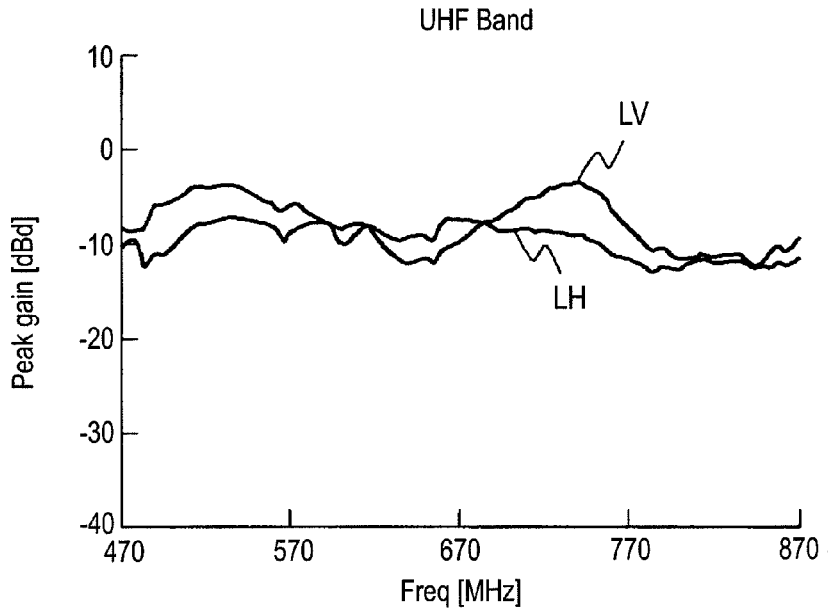
FIG. 18 is a characteristic curve graph showing the characteristics of an antenna according to a related-art configuration.
FIG. 19 is a table showing the characteristics of vertically polarized wave in the characteristic curve graph of FIG. 18.
FIG. 20 is a table showing the characteristics of horizontal polarized wave in the characteristic curve graph of FIG. 18.
Figures 21, 22, 23:
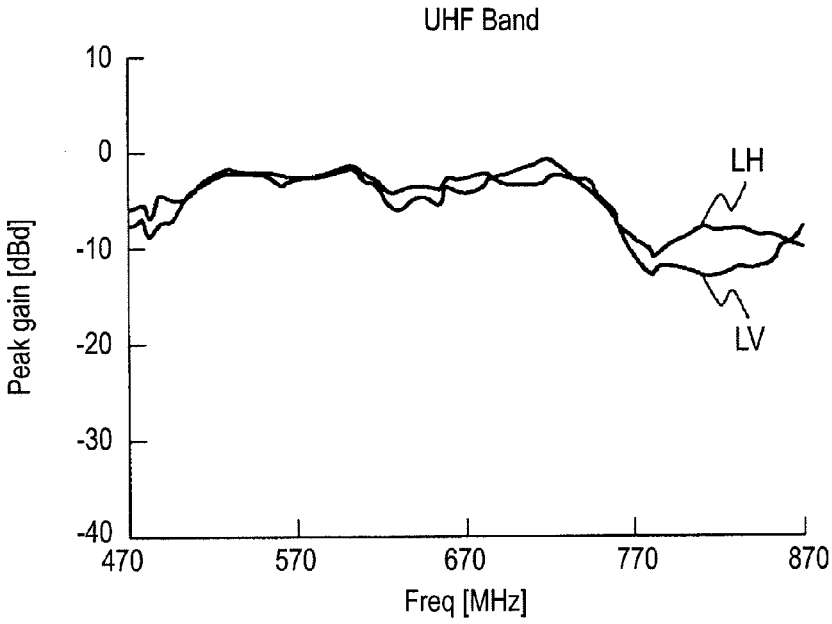
FIG. 21 is a characteristic curve graph showing the characteristics of an antenna according to the mobile telephone system of FIG. 2 when fitted to a human body.
FIG. 22 is a table showing the characteristics of vertically polarized wave in the characteristic curve graph of FIG. 21.
FIG. 23 is a table showing the characteristics of horizontal polarized wave in the characteristic curve graph of FIG. 21.
Figures 24, 25, 26:
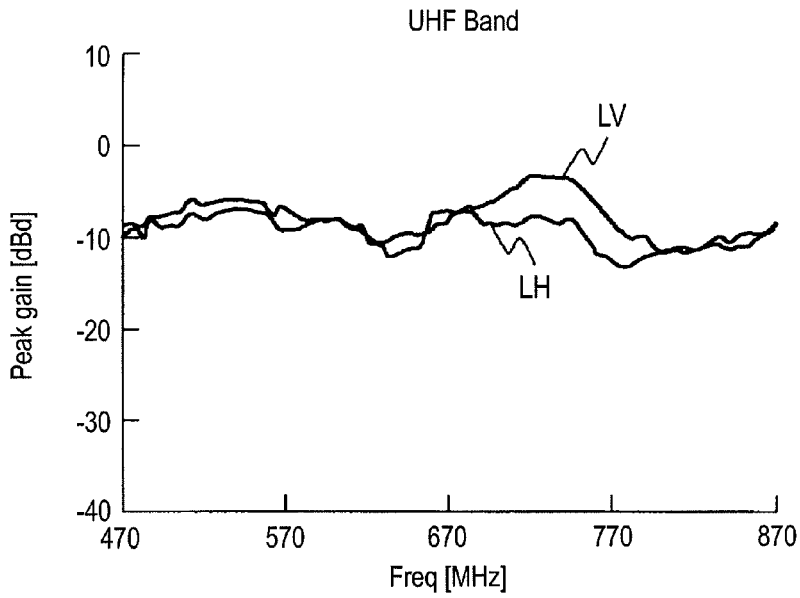
FIG. 24 is a characteristic curve graph showing the characteristics of an antenna according to a related-art configuration, when fitted to a human body.
FIG. 25 is a table showing the characteristics of vertically polarized wave in the characteristic curve graph of FIG. 24.
FIG. 26 is a table showing the characteristics of horizontal polarized wave in the characteristic curve graph of FIG. 24.

FIG. 15 is a characteristic curve graph showing the UHF band gain of the antenna of the mobile telephone system 1 in a free space. FIGS. 16 and 17 are tables illustrating the characteristics in FIG. 15 in detail. FIGS. 18 to 20 are a characteristic curve graph and tables showing the gain of the antenna in the mobile telephone system 1 in the case where the mobile telephone system 1 is actually put on a human body, in comparison with FIGS. 15 to 17. FIGS. 21 to 26 are characteristic curve graphs and tables showing the measurement results for the antenna according to the example of FIG. 14, in comparison with FIGS. 15 to 21. Note that in FIGS. 15 to 26, reference characters LH and LV represent the antenna input characteristics for the horizontal polarized wave and the vertically polarized wave, respectively.

These measurement results demonstrate that in a free space, the antenna of the mobile telephone system 1 significantly improves the gain when put on a human body, although the gain in a UHF band is slightly inferior.

It was confirmed that a sufficient antenna gain can be ensured in the VHF band in which the junction cable 2 and the earphone 3 function as a sleeve antenna, as in the UHF band.

However, the cable 10 needs to be cut at a mid portion thereof and reconnected in the case of configuring the cable so that the audio signals SAL and SAR can be transmitted by the core wire cables LL, LG, and LR, providing a high-frequency cut-off circuit at a mid portion thereof, and dividing the covered wire SS according to a related-art technique. In this case, the problems are that the portion that is reconnected becomes more complicated and larger, the parts count increases, and the mechanical strength degrades. In particular, in the case where a mid portion of the junction cable becomes large, another problem arises that the styling is degraded considerably.

Figure 27A:
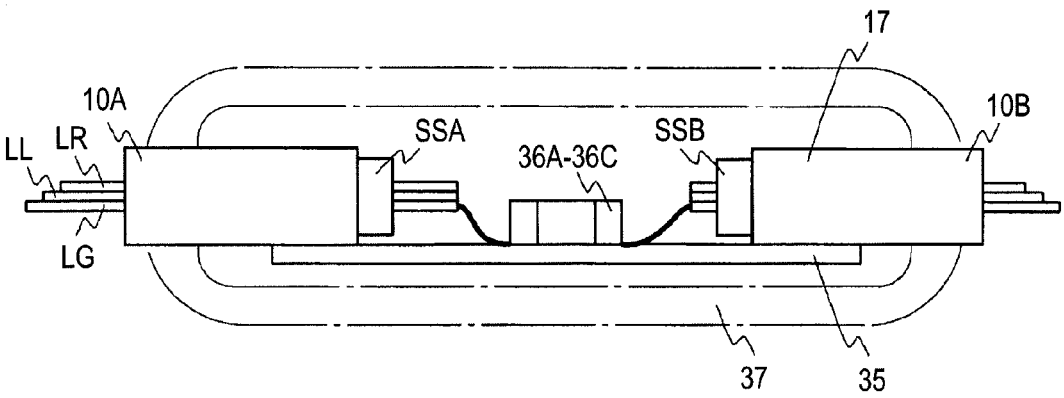
FIGS. 27A and 27B are views showing a case in which multicore coaxial cables are connected according to a related-art configuration.
Figure 27B:
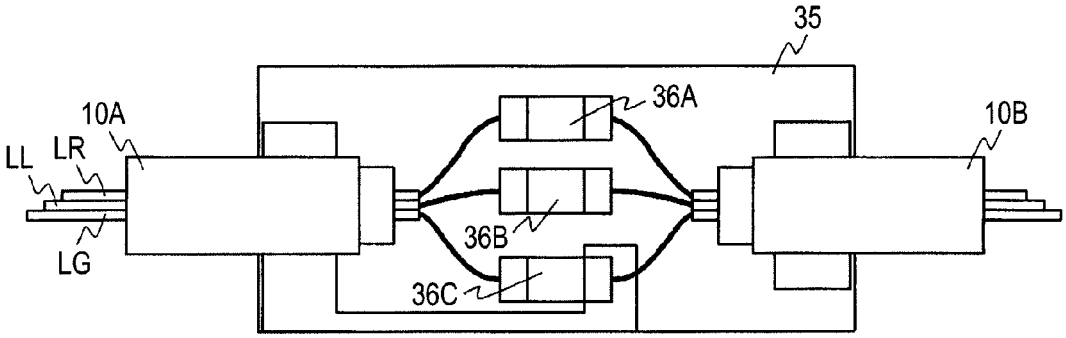

FIGS. 27A and 27B show a cross-sectional view and a plan view showing the configuration in the case where the high-frequency cut-off circuit is disposed according to the related-art technique, respectively. It should be noted that in FIGS. 27A and 27B, the related-art configuration will be described using the reference symbols used likewise in FIG. 1 and so forth. In the related-art technique, the main unit device-side and the earphone-side cables 10A and 10B are connected on a circuit board 35, and the connection between the cables 10A and 10B on the circuit board 35 is configured in various ways. Thereafter, the connected portion is molded with a resin 37 together with the circuit board 35. In FIGS. 27A and 27B, reference symbols 36A to 36C represent high-frequency cut-off circuits for cutting of high-frequency signals, which are constructed of chip inductors, for example.

Figure 28:
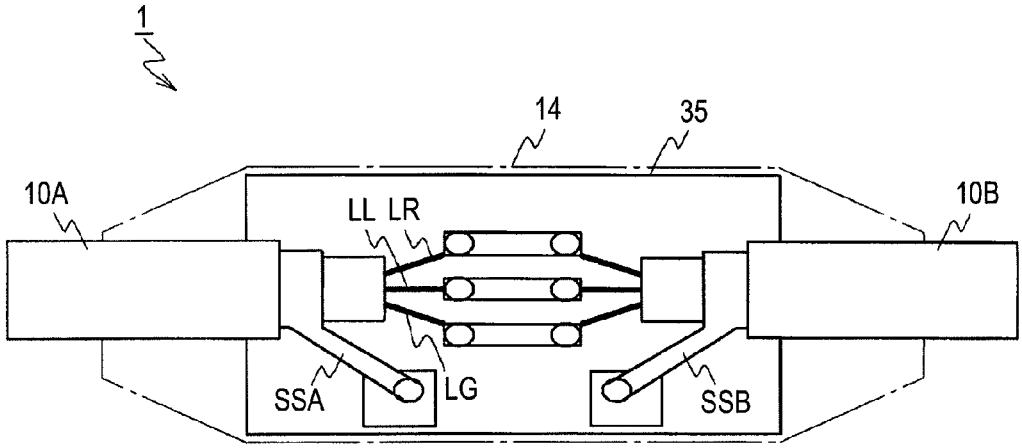
FIG. 28 is a view showing a case in which multicore coaxial cables are connected using the configuration of FIGS. 27A and 27B.

Accordingly, when an intermediate process portion is formed using this related-art technique, the main unit device-side cable 10A and the earphone-side cable 10B are connected on the circuit board 35, and only the corresponding core wire cables LL, LR, and LG of the cables 10A and 10B are connected respectively on the circuit board 35, as shown in FIG. 28 for comparison with FIGS. 27A and 27B. Thereafter, as indicated by the dash-dot lines, the connected portion together with the circuit board 35 is molded by a resin to form the intermediate process portion 14.

Figure 29:
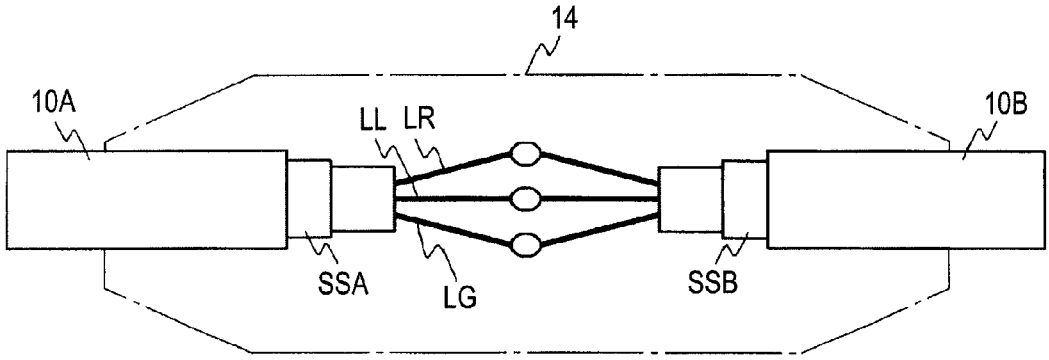
FIG. 29 is a view showing a case in which multicore coaxial cables are connected directly.

Consequently, in this method, the intermediate process portion 14 becomes more complicated and larger, and the parts count increases, and the mechanical strength lowers. As shown in FIG. 29 for comparison with FIG. 28, it may appear possible to employ a method in which the circuit board is eliminated and the cables 10A and 10B are directly connected to each other. However, in this method, the work becomes complicated, and there is a risk that defects such as connection failures and miswiring may occur. In addition, even when any of the techniques is used, the tensile strength inevitably degrades in the case where the intermediate process portion 14 is formed by connecting the main unit device-side cable 10A and the earphone-side cable 10B to each other.

In view of this, in the mobile telephone system 1, only the covered wire SS is cut at a mid portion thereof to form the intermediate process portion 14 (FIGS. 6A to 7C), so these problems are solved at one time. Specifically, it is unnecessary to provide a circuit board in the mobile telephone system 1 because only the covered wire SS is cut at amid portion thereof. As a result, the configuration of the intermediate process portion 14 can be simplified, and the shape can be made small. Moreover, the parts count is prevented from increasing.

Above all, since only the covered wire SS is cut at a mid portion thereof, the tensile strength achieved by the core wire cables LL, LR, and LG is kept to be the strength obtained before the covered wire SS is not yet cut. Here, the core wire cable in this type of multicore coaxial cable is prepared by covering aramid fiber-reinforced twisted wires, and the tensile strength for this type of multicore coaxial cable is ensured by the aramid fibers. Therefore, the mobile telephone system 1 can avoid the degradation of the mechanical strength resulting from the tensile strength effectively. Moreover, the preparation is easy because only the covered wire SS is cut at a mid portion thereof.

Furthermore, this embodiment is configured so that each of the covered wires SSA and SSB is bundled and made to protrude sideward, and when they are molded by a resin, the protruding portions get into the resin. As a result, the tensile strength in the intermediate process portion 14 can be improved further, and thereby the mechanical strength is increased further.

In addition, in the case where the junction cable 2 is prepared by cutting only the covered wire SS at a mid portion thereof, a fixed length of the junction cable 2 can be configured so as to be adaptable to various frequencies by varying the mid portion location at which the covered SS wire is cut.

Advantages of the Embodiment

The above-described configuration makes it possible to construct an earphone antenna in a small size easily while ensuring sufficient mechanical strength, by preparing the junction cable by a multicore coaxial cable and configuring the junction cable so as to function a portion thereof as an antenna by cutting only the covered wire of the multicore coaxial cable.

Moreover, since this part that functions as an antenna is a part on the main unit device side, the adverse effects caused by a human body can be avoided effectively to construct the earphone antenna.

Furthermore, by disposing a core in this cut part, the high-frequency signal induced on the earphone side from the intermediate process portion can be prevented from getting into the main unit device-side covered wire. As a result, the main unit device-side covered wire can be functioned as a more ideal monopole antenna to improve the performance.

Second Embodiment

Figure 30:
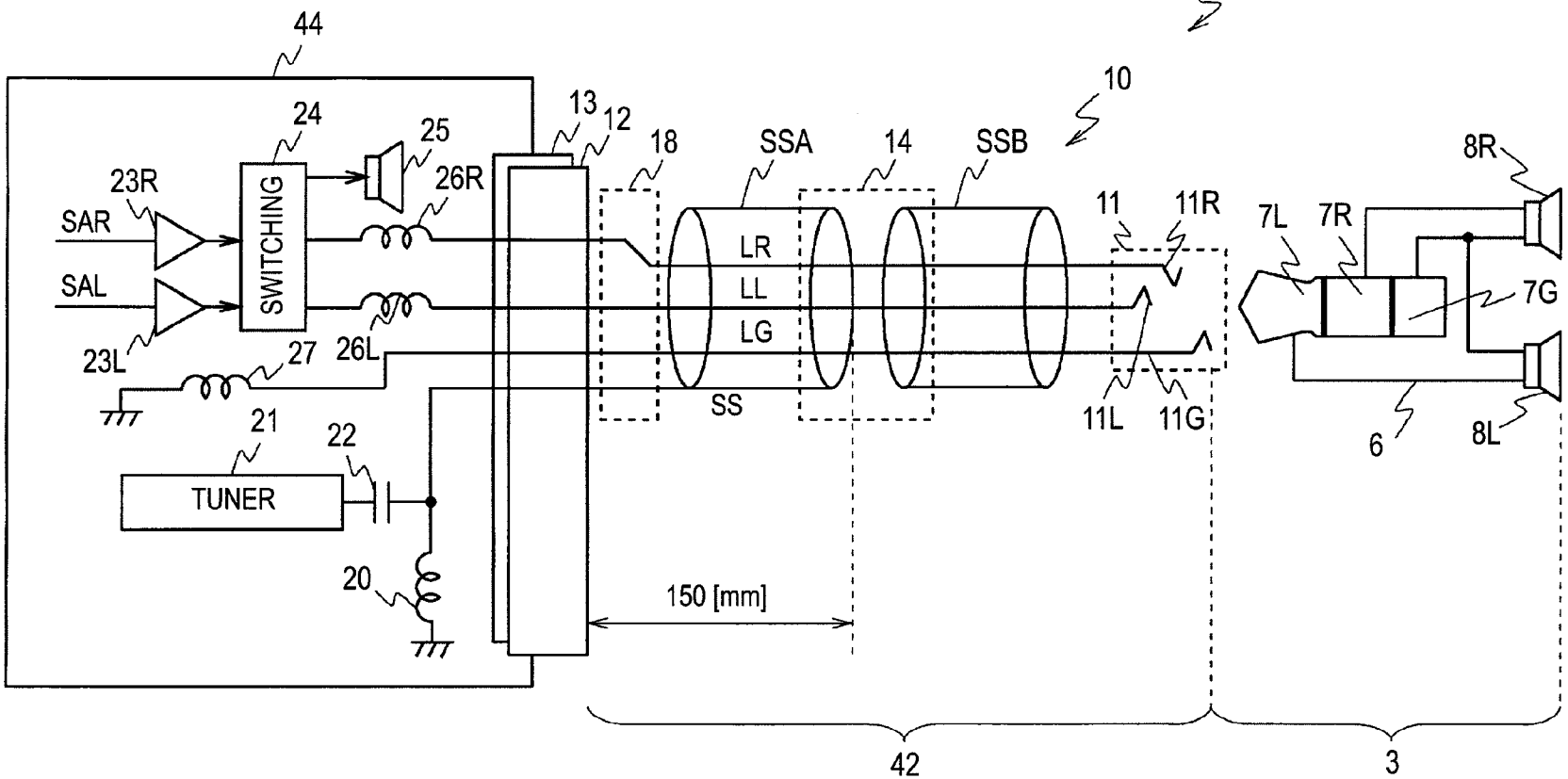
FIG. 30 is a connection diagram showing a mobile telephone system according to a second embodiment of the invention.

FIG. 30 is a connection diagram showing a mobile telephone system according to a second embodiment of the invention, for comparison with FIG. 1. This mobile telephone system 41 is constructed in the same fashion as the mobile telephone system 1 of the first embodiment except that a junction cable 42 and a mobile telephone 44 are used in place of the junction cable 2 and the mobile telephone 4.

Here, the junction cable 42 is constructed in the same manner as the junction cable 2, except that the grounding core wire cable LG and the covered wire SSA are individually connected to the mobile telephone 44 via the plug 12 and the jack 13.

In the mobile telephone 44, the grounding core wire cable LG is grounded via the high-frequency cut-off circuit 27. The covered wire SSA is grounded via the high-frequency cut-off circuit 20 and is connected to the antenna input port of the tuner 21 via the capacitor 22. The mobile telephone 44 is constructed in the same manner as the mobile telephone 4, except that these connections of the grounding core wire cable LG and the covered wire SSA are different therefrom.

Thus, in this mobile telephone system 41, the main unit device-side covered wire SSA is made to function as a monopole antenna to receive digital television broadcast, as in the first embodiment.

The same advantageous effects as obtained in the first embodiment can be obtained when, as in this embodiment, the grounding core wire cable and the main unit device-side covered wire are individually connected to the main unit device so that the main unit device-side covered wire can function as a monopole antenna.

Third Embodiment

Figure 31:
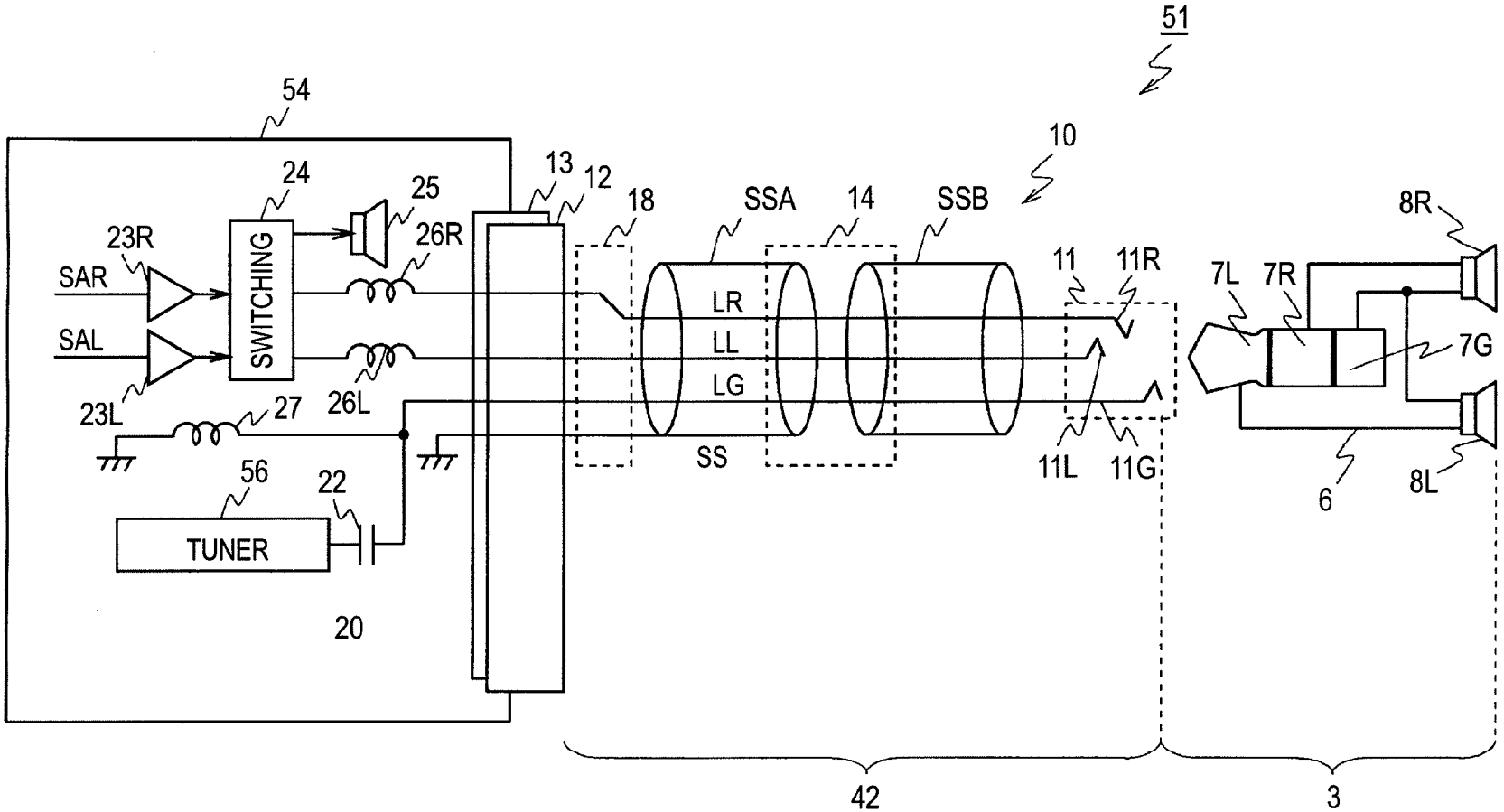
FIG. 31 is a connection diagram showing a mobile telephone system according to a third embodiment of the invention.

FIG. 31 is a connection diagram showing a mobile telephone system according to a third embodiment of the invention, for comparison with FIGS. 1 and 30. This mobile telephone system 51 is constructed in the same fashion as the mobile telephone system 41 of the second embodiment except that a mobile telephone 54 are used in place of the mobile telephone 4.

In the mobile telephone 54, a tuner 56 that can receive only digital radio broadcast is provided in place of the tuner 21. In the mobile telephone 54, the covered wire SS is grounded. In addition, the grounding core wire cable LG is grounded via the high-frequency cut-off circuit 27 and is connected to the antenna input port of the tuner 56 via the capacitor 22. The mobile telephone 54 is constructed in the same manner as the mobile telephone 44, except that these connections of the grounding core wire cable LG and the covered wire SSA are different therefrom.

Thus, in this mobile telephone system 51, the junction cable 42 and the earphone 3 are made to function as a sleeve antenna to receive digital radio broadcast, as for the VHF band in the first embodiment. Note that the adverse effects of the noise from the main unit device can be alleviated in the case where the main unit device-side covered wire SS is made to function as a coaxial transmission line to construct a sleeve antenna in this way.

The same advantageous effects as obtained in the first embodiment can be obtained also when, as in this embodiment, the main unit device-side covered wire is made to function as a coaxial transmission line to construct a sleeve antenna.

Fourth Embodiment

Figure 32:
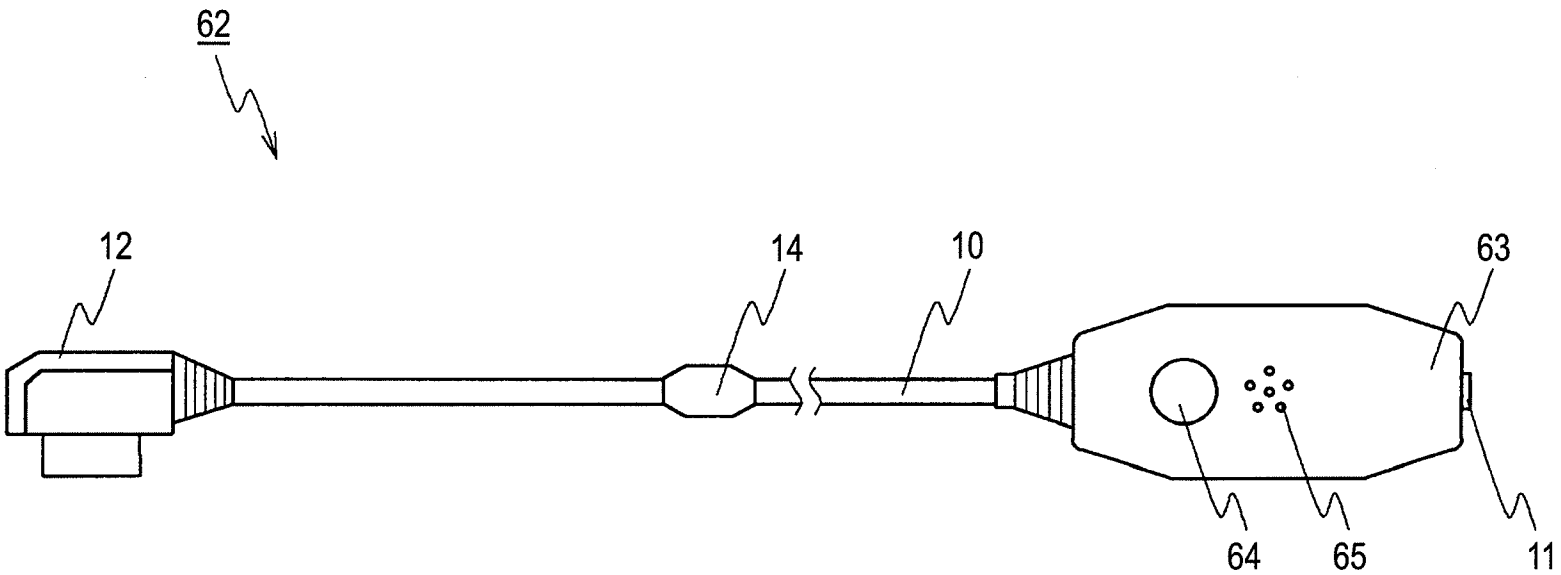
FIG. 32 is a view showing a junction cable used for a mobile telephone system according to a fourth embodiment of the invention.

FIG. 32 is a plan view showing a junction cable used for a mobile telephone system according to a fourth embodiment of the invention. This junction cable 62 is used for a mobile telephone that can receive one or both of digital radio broadcast and digital television broadcast. In the junction cable 62, a remote control unit 63 is provided at the earphone side end of the cable 10. A switch 64 for operating off-hook and on-hook and a microphone 65 for constructing a hands-free system are provided in the remote control unit 63. The jack 11 is provided on an end face of the remote control unit 63.

The mobile telephone and the junction cable 62 are constructed in the same manner as those in first to third embodiments, except that the structures concerning the remote control unit 63 are different therefrom. Thus, core wire cables concerning the switch 64 and the microphone 66 are provided additionally in the cable 10, in comparison with the foregoing embodiments. These core wire cables are connected to the mobile telephone.

The same advantageous effects as obtained in the foregoing first to third embodiments can be obtained also when the remote control unit is provided at one end of the junction cable as in this embodiment.

Fifth Embodiment

Figure 33:
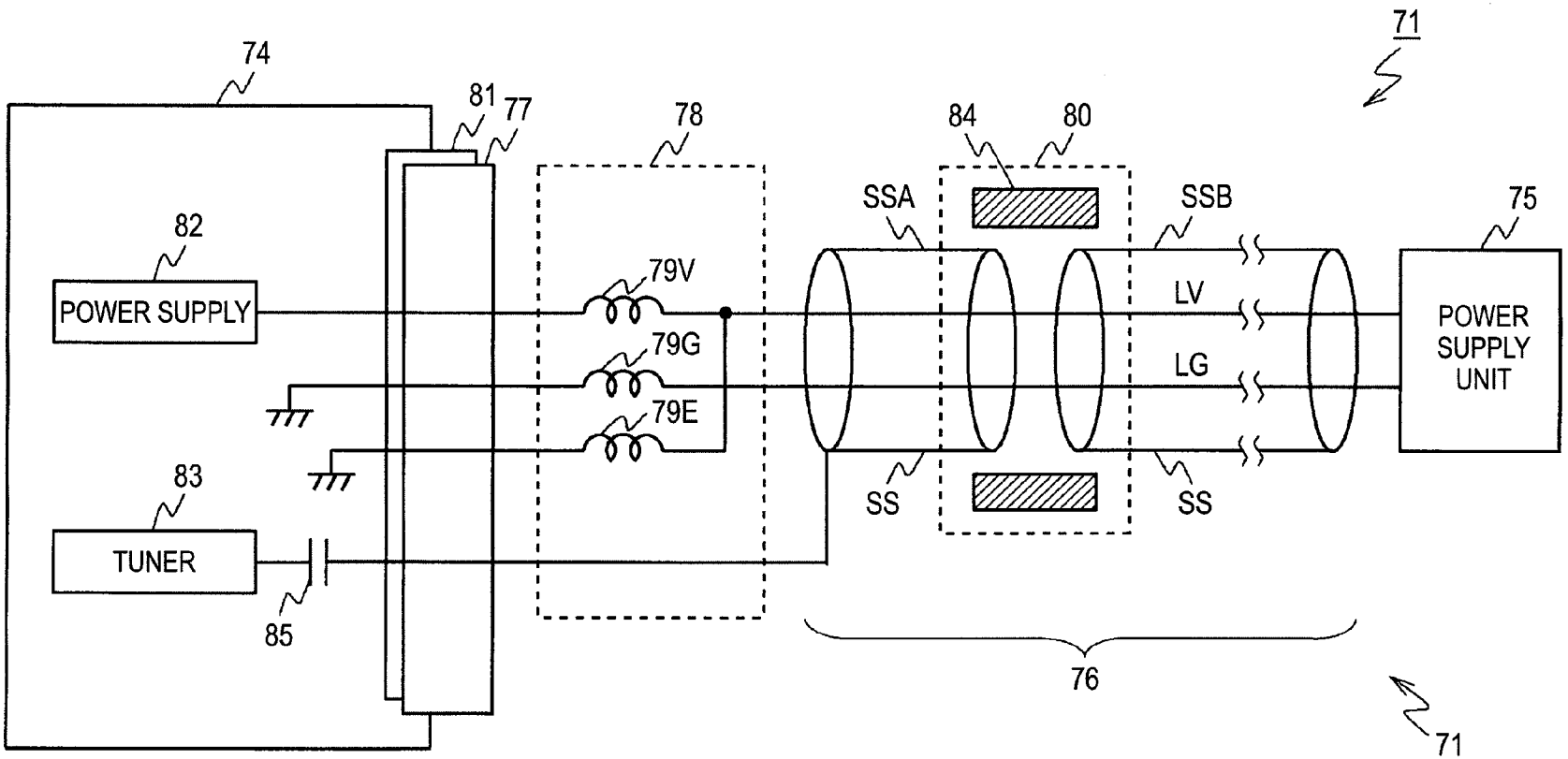
FIG. 33 is a connection diagram showing a mobile telephone system according to a fifth embodiment of the invention.

FIG. 33 is a connection diagram showing a mobile telephone system according to a fifth embodiment of the invention. This mobile telephone system 71 downloads music contents using Media FLO (registered trademark), which is a download service utilizing broadcast waves. In this mobile telephone system 71, an antenna for receiving the broadcast waves of the download service is constructed by a power supply apparatus 72 for supplying electric power for charging to a mobile telephone 74.

Here, the power supply apparatus 72 has a power supply unit 75 and a connector 77 provided at respective ends of a cable 76. Here, the power supply unit 75 generates electric power for charging from a commercial power supply and outputs the power to the cable 76.

The cable 76 is a multicore coaxial cable in which two core wire cables LV and LG are covered by the covered wire SS. The power supply unit 75 side end of the cable 76 is directly connected to the power supply unit 75. The mobile telephone 74 side end of the cable 76 is connected to the connector 77 via a circuit board 78 provided on the rear face of the connector 77. In the cable 76, the core wire cables LV and LG are assigned for transmission of the electric power generated by the power supply unit 75, and the core wire cables LV and LG are respectively connected to the hot-side power supply terminal and the cold-side power supply terminal of the connector 77 via choke coils 79V and 79G provided in the circuit board 78. The core wire cable LV connected to the hot-side power supply terminal is connected to the ground terminal of the connector 77 via a choke coil 79E also provided in the circuit board 78. These choke coils 79V, 79G, and 79E prevent the noise from entering the mobile telephone 74 from the power supply lines.

An intermediate process portion 80 is provided at a certain distance from the connector 77 in the cable 76. Only the covered wire SS of the cable 76 is cut at the intermediate process portion 80 in the same manner as in the first embodiment, and the covered wire SS is divided into the main unit device-side covered wire SSA and the power supply unit-side covered wire SSB.

The cable 76 is inserted through a core 84 in a tubular shape, and the core 84 is disposed at the portion at which the covered wire SS has been cut. Thereafter, that portion is covered with a resin to form the intermediate process portion 80.

The cable 76 is configured in a state in which the power supply unit-side covered wire SSB is not connected to any part, and the main unit device-side covered wire SSA is connected to the antenna terminal of the connector 77 via the circuit board 78. Thus, in this mobile telephone system 71, a monopole antenna is formed by the main unit device-side covered wire SSA, as in the first embodiment. In the mobile telephone system 71, the length of the main unit device-side covered wire SSA is set at about ¼ wavelength of the wavelength of the broadcast wave of the download service.

The mobile telephone 74 is provided with a connector 81 to which the connector 77 is connected. The electric power transmitted by the core wire cables LV and LG of the cable 76 is input to a electric power circuit 82 via the connector 81. Here, the electric power circuit 82 charges a built-in secondary battery by this electric power.

The antenna input port of the connector 81 is connected to a tuner 83 via a capacitor 85. The tuner 83 receives the broadcast waves of the download service by the high-frequency signal induced in the cable 76. The mobile telephone 74 processes the received broadcast wave to reproduce the music content, and retains the music content by recording it in a predetermined recording medium. Also, the mobile telephone 74 reproduces the music contents recorded in the recording medium in response to the user's operation and offers it to the user.

According to this embodiment, the cable for transmitting electric power is formed by a multicore coaxial cable, and only the covered wire of the multicore coaxial cable is cut at a mid portion so that it can be configured to partially function as an antenna, by applying this embodiment of the invention to a power supply apparatus. Thereby, this embodiment makes it possible to construct an antenna in a small size easily while ensuring sufficient mechanical strength.

Moreover, sufficient antenna gain can be ensured in comparison with the case of using a built-in antenna. As a result, desired music contents can be downloaded reliably at various places.

Furthermore, a core is disposed in the intermediate process portion. This makes it possible to reduce the noise or the like from the power supply line. What is more, the power supply unit-side cable from the intermediate process portion can be configured so as not to function as an antenna, and the main unit device-side covered wire is allowed to function as a more ideal monopole antenna, to improve the characteristics.

Sixth Embodiment

Figure 34:
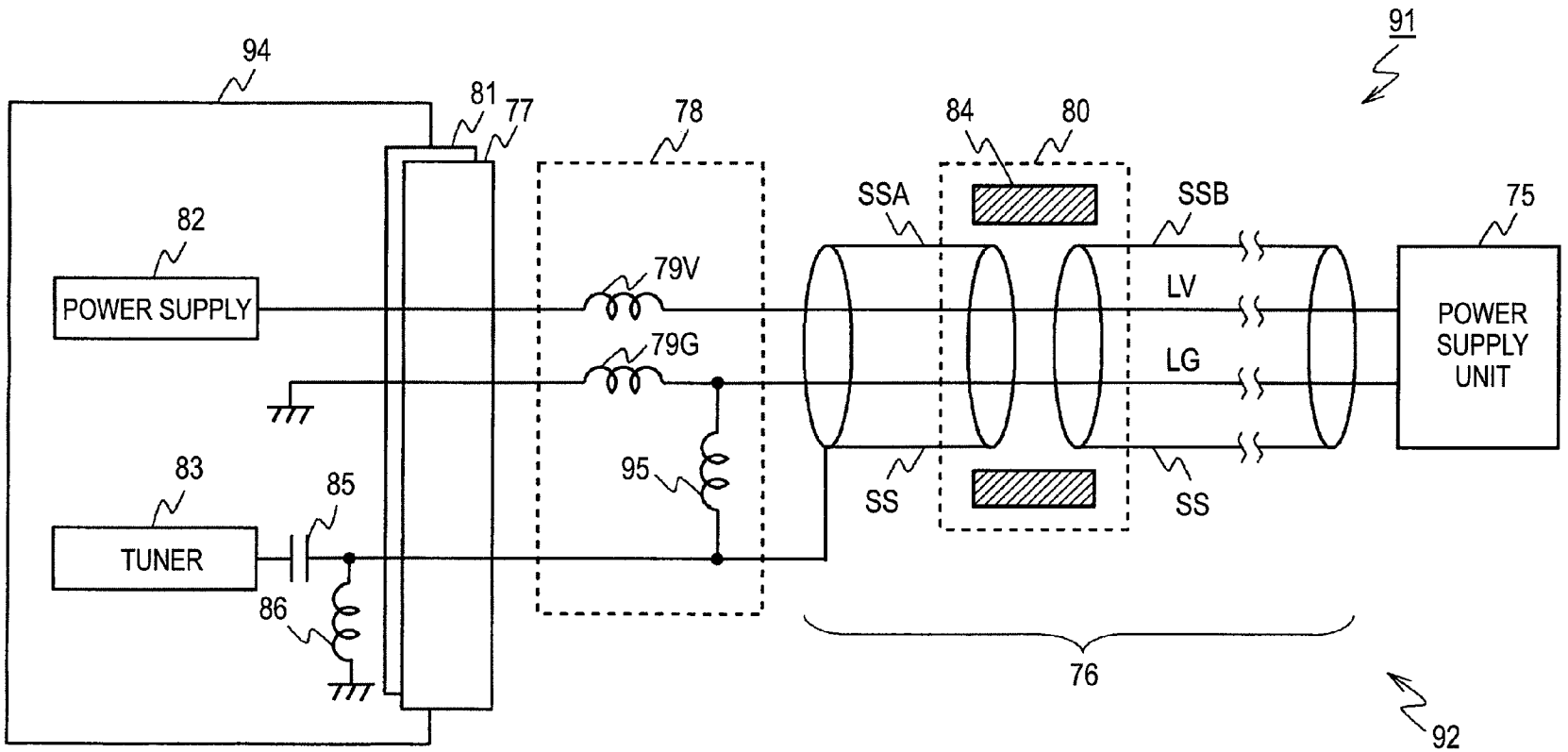
FIG. 34 is a connection diagram showing a mobile telephone system according to a sixth embodiment of the invention.

FIG. 34 is a connection diagram showing a mobile telephone system according to a sixth embodiment of the invention. This mobile telephone system 91 uses a power supply apparatus 92 and a mobile telephone 94 in place of the power supply apparatus 72 and the mobile telephone 74.

Also, in the power supply apparatus 92, the core wire cable LG for the cold-side power supply is connected to the covered wire SSA via the high-frequency cut-off circuit 95 on the circuit board 78, and is further connected to the cold-side power supply terminal of the connector 77 via the coke coil 79G. The covered wire SSA is connected to the antenna input port of the connector 77. The power supply apparatus 92 is constructed in the same manner as the power supply apparatus 72 of the fifth embodiment, except that the configurations of the core wire cable LG for the cold-side power supply and the covered wire SSA are different therefrom.

In the mobile telephone 94, the antenna input port of the connector 81 is grounded via a high-frequency cut-off circuit 86, and is further connected to the antenna input port of the tuner 83 via the capacitor 85. The mobile telephone 94 is constructed in the same manner as the mobile telephone 74 of the fifth embodiment except that the configuration concerning the antenna input of the tuner 83 is different therefrom.

Accordingly, the same advantageous effects as obtained in the fifth embodiment can be obtained when the cable of the power supply apparatus is connected to the tuner of the mobile telephone by a connection different from that in the fifth embodiment and the main unit device-side covered wire of this cable is made to function as a monopole antenna, as in the sixth embodiment.

Seventh Embodiment

Figure 35:
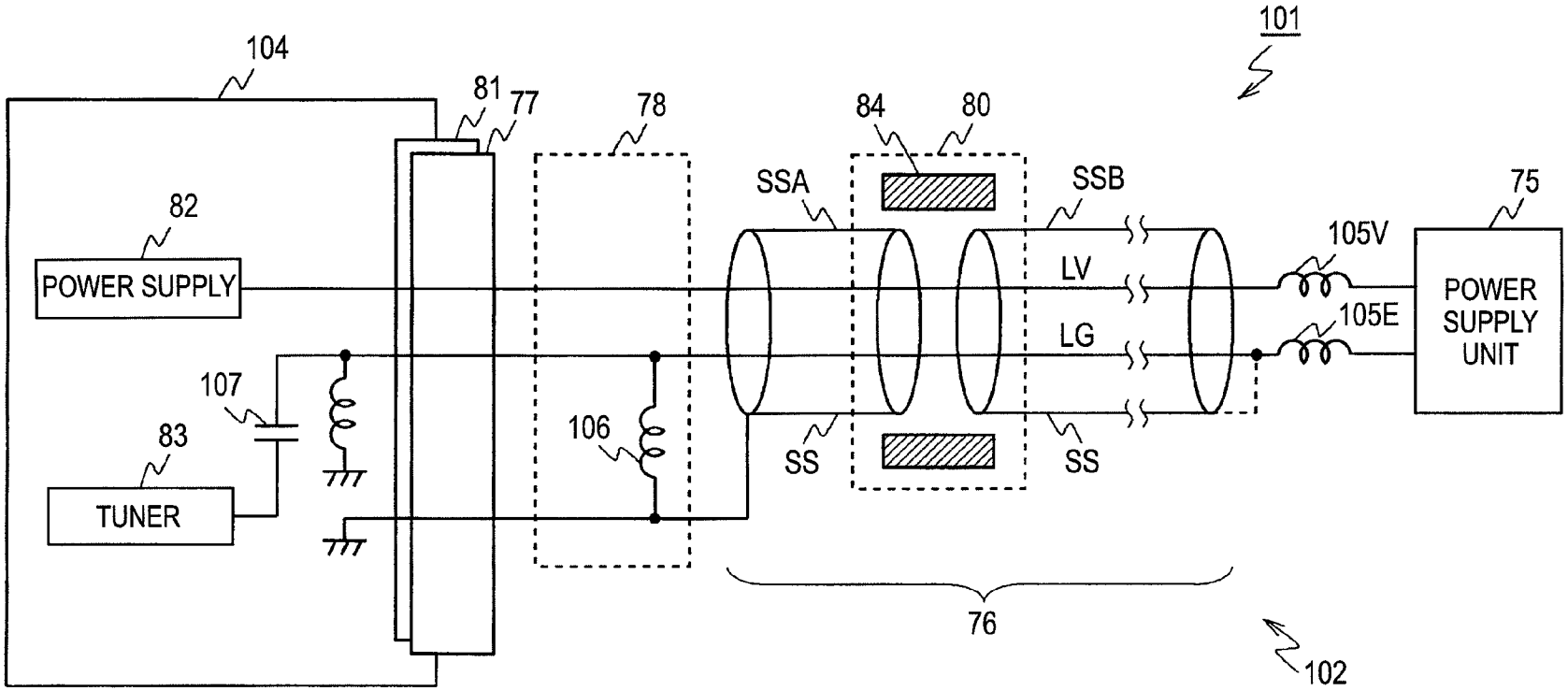
FIG. 35 is a connection diagram showing a mobile telephone system according to a seventh embodiment of the invention.

FIG. 35 is a connection diagram showing a mobile telephone system according to a seventh embodiment of the invention. This mobile telephone system 101 uses a power supply apparatus 102 and a mobile telephone 104 in place of the power supply apparatus 72 and the mobile telephone 74.

The power supply apparatus 102 is constructed in the same manner as the power supply apparatus 72, except that the connection of the cable 76 is different therefrom. Here, the cable 76 is connected to the power supply unit 75 via high-frequency cut-off circuits 105E and 105V at the power supply unit 75 side end of the core wire cables LV and LG. Thereby, the mobile telephone system 101 restricts the electrical length of the power supply unit 75 side by the high-frequency cut-off circuit 105E and 105V in a frequency band of the broadcast waves that are receiving in the mobile telephone system 101. Note that the high-frequency cut-off circuits 105E and 105V are constructed of, for example, chip inductors. It should be noted that the high-frequency cut-off circuit 105E side end of the grounding core wire cable LG may be connected to the covered wire SSB, as indicated by the dashed lines. In the power supply apparatus 102, the length of the power supply unit-side covered wire SSB is set at a ¼ wavelength of the wavelength of the broadcast wave of the download service.

The core wire cables LV and LE are connected directly to the power supply terminal of the connector 77. Also, the ground wire-side core wire cable LG is connected to the covered wire SSA on the circuit board 78 via a high-frequency cut-off circuit 106, and the covered wire SSA is connected to the ground terminal of the connector 77.

In the mobile telephone 104, the cold-side power supply terminal of the connector 81 is connected to the antenna input port of the tuner 83 via a capacitor 107, and is connected to the ground wire of the audio output system. In addition, the ground terminal of the connector 81, to which the covered wire SSA is connected, is connected to the ground wire of the tuner 83. The mobile telephone 104 is constructed in the same manner as the mobile telephone 74, except that the connection of these components are different therefrom. Thus, the mobile telephone 104 receives broadcast waves by the sleeve antenna in which the covered wire SSB of the cable 76 on the power supply unit 75 side functions as an antenna.

In this embodiment, by applying the embodiment of the invention to the power supply apparatus, the cable for transmitting electric power may be formed by a multicore coaxial cable, and only the covered wire of the multicore coaxial cable may be cut at a mid portion so that it can be configured to partially function as an antenna. This also makes it possible to obtain the same advantageous effects as in the foregoing embodiments.

Modified Example

The foregoing embodiments have described cases in which the length of the covered wire is set at a length corresponding to the frequency of digital television broadcast or a length corresponding to the broadcast wave of the download service. However, the invention is not limited thereto but may be applied widely to various cases in which various types of broadcast waves are to be received. Specifically, for example, in the case where the VHF band with the center frequency of 200 [MHz] is to be received, the broadcast wave of the VHF band may be received by configuring the intermediate process portion so that the length of the part that is made to function as an antenna becomes about 400 [mm].

In addition, the foregoing embodiments have described cases in which the lengths of the earphone-side covered wire and the power supply unit-side covered wire are not particularly set in the configuration in which the main unit device-side covered wire is made to function as a monopole antenna. However, the invention is not limited thereto, and the performance of the monopole antenna formed by the main unit device-side covered wire may be enhanced by setting the lengths of the earphone-side covered wire and the power supply unit-side covered wire. Specifically, for the reception frequency received by the main unit device-side covered wire, the interference wave received by the earphone cable and the power supply unit can be reduced by forming a filter circuit for suppressing interference waves by the earphone-side covered wire and the power supply unit-side covered wire. In this case, for example, the filter circuit may be formed by setting the length of the earphone-side covered wire and the power supply unit-side covered wire at ½ the wavelength of the interference wave and making the earphone-side covered wire and the power supply unit-side covered wire function as a stub.

In addition, the foregoing embodiments have described cases in which the junction cable and the earphone are detachably connected using a connector. However, the invention is not limited thereto, but may be applied widely to cases in which the junction cable and the earphone are irremovably connected in what is called a built-in manner.

The fourth to seventh embodiments have described cases in which the cable extending from the power supply unit is made to function as an antenna. However, the invention is not limited thereto, and the cable extending from the power supply unit may be connected to the main unit device via the junction cable, and the junction cable may be made to function as an antenna, as in the case of the earphone antenna.

Furthermore, although the foregoing embodiments have described cases in which the cases for earphone and power supply are used as antennas, the invention is not limited thereto. For example, the invention may be applied widely to various cases in which various signals, such as audio signals and video signals, and moreover electric power are transmitted to various external devices, such as the cases in which various external devices are connected to the main unit device by USB.

The foregoing embodiments have described cases in which the embodiments of the invention are applied to a mobile telephone system. However, the invention may be applied widely to various other receiver apparatus including, but not limited to, a mobile music player that has a broadcast wave receiving function.

The embodiments of the invention may be applied to a mobile telephone that can receive digital television broadcast.

The present application contains subject matter related to that disclosed in Japanese Priority Patent Application JP 2008-219320 filed in the Japan Patent Office on Aug. 28, 2008, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A receiver apparatus comprising:

a main unit device; and a junction cable configured to transmit one or both of signal and electric power between the main unit device and an external device, wherein the junction cable is a multicore coaxial cable having a plurality of core wire cables and a covered wire covering the plurality of core wire cables, and in the junction cable, only the covered wire is cut locally so that the covered wire is divided into a main unit device-side covered wire and an external device-side covered wire, and the main unit device transmits one or both of the signal and electric power by the core wire cable, and the main unit device-side covered wire or the core wire cable is connected to an antenna input port of a built-in tuner, and the main unit device receives a desired broadcast wave with the tuner using a high-frequency signal induced in the main unit device-side covered wire or the external device-side covered wire, when receiving a first type signal, the first type signal is received by a monopole antenna formed by the main unit device-side covered wire, and when receiving a second type signal, the second type signal is received by a sleeve antenna formed by the external device-side covered wire, and wherein an intermediate process portion is provided at a certain distance from the antenna input port, and only the covered wire is cut at the intermediate process portion so that the covered wire is divided into a main unit device-side covered wire and an external device-side covered wire, and the junction cable is inserted through a core in a tubular shape, and the core is disposed at the portion at which the covered wire is cut.

2. The receiver apparatus as set forth in claim 1, wherein the junction cable is detachably connected to one or both of the main unit device and the external device by a connector.

3. The receiver apparatus as set forth in claim 2, wherein the external device is an earphone.

4. A junction cable comprising:

a multicore coaxial cable having a plurality of core wire cables and a covered wire covering the plurality of core wire cable;

a main unit device-side connector provided at one end of the multicore coaxial cable and configured to connect the multicore coaxial cable to a main unit device; and an external device-side connector provided at the other end of the multicore coaxial cable and configured to connect the multicore coaxial cable to an external device, wherein only the covered wire is cut locally, and the covered wire is divided into a main unit device-side covered wire and an external device-side covered wire, the core wire cable transmits one or both of signal and electric power between the main unit device and the external device, and the main unit device-side covered wire or the core wire cable is connected via the main-unit side connector to an antenna input port of a tuner being built in the main unit device, when receiving a first type signal, the first type signal is received by a monopole antenna formed by the main unit device-side covered wire, and when receiving a second type signal, the second type signal is received by a sleeve antenna formed by the external device-side covered wire, and wherein an intermediate process portion is provided at a certain distance from the antenna input port, and only the covered wire is cut at the intermediate process portion so that the covered wire is divided into a main unit device-side covered wire and an external device-side covered wire, and the junction cable is inserted through a core in a tubular shape, and the core is disposed at the portion at which the covered wire is cut.

5. The junction cable as set forth in claim 4, wherein the external device is an earphone.

6. A power supply apparatus comprising:

a power supply unit configured to generate electric power for a main unit device; and a cable configured to supply the electric power generated by the power supply unit to the main unit device via a connector provided at one end, wherein the cable is a multicore coaxial cable having a plurality of core wire cables and a covered wire covering the plurality of core wire cables, only the covered wire is cut locally, and the covered wire is divided into a main unit device-side covered wire and an external device-side covered wire, the core wire cable supplies the electric power to the main unit device, and the main unit device-side covered wire or the core wire cable is connected via the connector to an antenna input port of a tuner being built in the main unit device, when receiving a first type signal, the first type signal is received by a monopole antenna formed by the main unit device-side covered wire, when receiving a second type signal, the second type signal is received by a sleeve antenna formed by the external device-side covered wire, and wherein an intermediate process portion is provided at a certain distance from the antenna input port, and only the covered wire is cut at the intermediate process portion so that the covered wire is divided into a main unit device-side covered wire and an external device-side covered wire, and the junction cable is inserted through a core in a tubular shape, and the core is disposed at the portion at which the covered wire is cut.

* * * * *